US009132526B2

(12) United States Patent
Smith et al.

(10) Patent No.: US 9,132,526 B2
(45) Date of Patent: Sep. 15, 2015

(54) CHEMICAL MECHANICAL PLANARIZATION CONDITIONER

(75) Inventors: Joseph Smith, Andover, MA (US); Andrew Galpin, Nashua, NH (US); Christopher Wargo, Wellesley, MA (US)

(73) Assignee: Entegris, Inc., Billerica, MA (US)

( * ) Notice: Subject to any disclaimer, the term of this patent is extended or adjusted under 35 U.S.C. 154(b) by 78 days.

(21) Appl. No.: 14/004,152

(22) PCT Filed: Mar. 6, 2012

(86) PCT No.: PCT/US2012/027916

§ 371 (c)(1), (2), (4) Date: Dec. 17, 2013

(87) PCT Pub. No.: WO2012/122186

PCT Pub. Date: Sep. 13, 2012

(65) Prior Publication Data

US 2014/0113532 A1 Apr. 24, 2014

Related U.S. Application Data

(60) Provisional application No. 61/513,294, filed on Jul. 29, 2011, provisional application No. 61/506,483, filed on Jul. 11, 2011, provisional application No. 61/449,851, filed on Mar. 7, 2011.

(51) Int. Cl.
*B24B 53/017* (2012.01)

(52) U.S. Cl.
CPC ..... *B24B 53/017* (2013.01)

(58) Field of Classification Search
CPC ..... B24B 53/017; B24B 53/12; B24D 3/06; B24D 18/00; B24D 37/04
USPC ..... 451/443, 548, 550, 551, 549, 56, 72
See application file for complete search history.

(56) References Cited

U.S. PATENT DOCUMENTS 4,706,416 A * 11/1987 Kottas ..... 451/359
5,186,973 A 2/1993 Garg et al.

(Continued)

FOREIGN PATENT DOCUMENTS

EP 0 540 366 A1 5/1993
JP 2003-053665 A 2/2003
WO WO 2011/130300 A1 10/2011

OTHER PUBLICATIONS

Vishal Khosla, et al, "Standardized Functional Tests of Pad Conditioners," pp. 589-592, Proceedings, Eleventh International Chemical Mechanical Planarization for ULSI Multilevel Interconnection Conference (CMP-MIC Conference), Feb. 21-23, 2006, Fremont CA, Library of Congress No. 89-644090.

*Primary Examiner* — George Nguyen
(74) *Attorney, Agent, or Firm* — Christensen Fonder P.A.

(57) ABSTRACT

A pad conditioner for a CMP polishing pad is disclosed that includes a substrate that has a matrixical arrangement of protrusions that have a layer of poly crystalline diamond on at least their top surfaces. The protrusions may have varying shapes and elevations and may comprise a first set of protrusions and a second set of protrusions, the first set of protrusions have a first average height and the second set of protrusions have a second average height, the first average height different from the second average height, a top of each protrusion in the first set of protrusions has a non-flat surface and a top of each protrusion in the second set of protrusions has a non-flat surface.

23 Claims, 10 Drawing Sheets

(56) References Cited

U.S. PATENT DOCUMENTS

| | | | | |
|---|---|---|---|---|
| 5,626,509 | A * | 5/1997 | Hayashi | 451/285 |
| 6,027,659 | A * | 2/2000 | Billett | 216/11 |
| 6,054,183 | A | 4/2000 | Zimmer et al. | |
| 6,213,856 | B1 * | 4/2001 | Cho et al. | 451/443 |
| 6,439,986 | B1 * | 8/2002 | Myoung et al. | 451/443 |
| 6,632,127 | B1 | 10/2003 | Zimmer et al. | |
| 6,821,189 | B1 * | 11/2004 | Coad et al. | 451/41 |
| 7,201,645 | B2 | 4/2007 | Sung | |
| 7,367,875 | B2 | 5/2008 | Slutz et al. | |
| 7,799,375 | B2 | 9/2010 | Rashed et al. | |
| 8,905,823 | B2 * | 12/2014 | Wu et al. | 451/443 |
| 2002/0182401 | A1 | 12/2002 | Lawing | |
| 2003/0114094 | A1 | 6/2003 | Myoung et al. | |
| 2004/0009742 | A1 * | 1/2004 | Lin et al. | 451/56 |
| 2005/0095959 | A1 * | 5/2005 | Sung | 451/56 |
| 2006/0055864 | A1 | 3/2006 | Matsumura et al. | |
| 2006/0128288 | A1 | 6/2006 | An et al. | |
| 2007/0167117 | A1 | 7/2007 | Moon et al. | |
| 2008/0153398 | A1 | 6/2008 | Sung | |
| 2009/0123705 | A1 * | 5/2009 | Sung | 428/167 |
| 2010/0248595 | A1 * | 9/2010 | Dinh-Ngoc et al. | 451/56 |
| 2011/0076925 | A1 * | 3/2011 | Sung | 451/8 |
| 2011/0250826 | A1 | 10/2011 | Yoon et al. | |
| 2012/0171935 | A1 * | 7/2012 | Ruland et al. | 451/56 |
| 2012/0302146 | A1 * | 11/2012 | Sung | 451/443 |
| 2013/0273820 | A1 * | 10/2013 | Sung | 451/443 |
| 2014/0099868 | A1 * | 4/2014 | Sung | 451/56 |
| 2014/0113532 | A1 * | 4/2014 | Smith et al. | 451/443 |
| 2015/0087212 | A1 | 3/2015 | Doering et al. | |

* cited by examiner

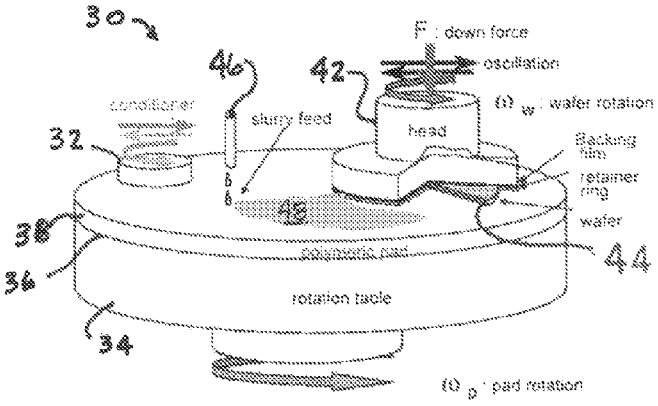
FIG. 1
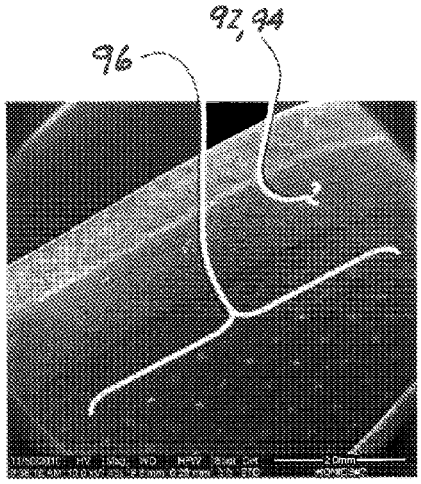
FIG. 3D
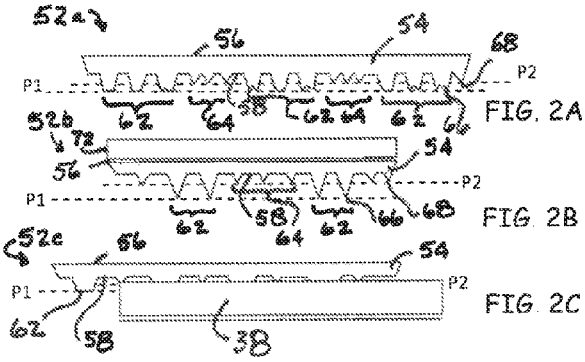
FIG. 2A
FIG. 2B
FIG. 2C
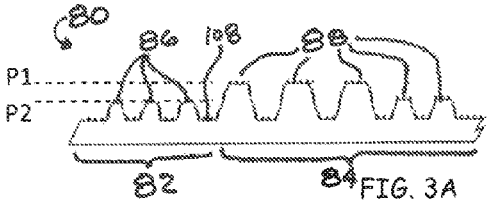
FIG. 3A
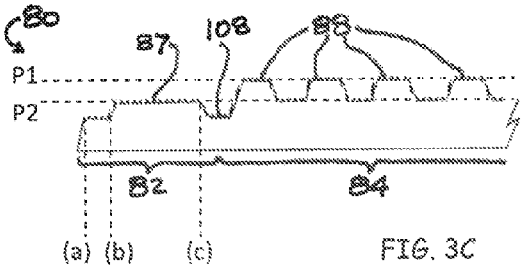
FIG. 3C
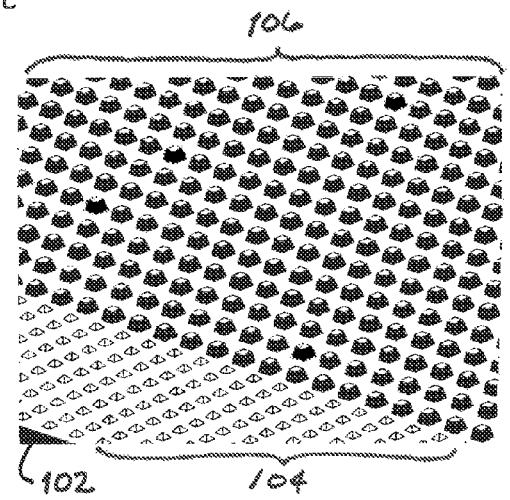
FIG. 3B

CHEMICAL MECHANICAL PLANARIZATION CONDITIONER

PRIORITY CLAIM

The present application is a National Phase entry of PCT Application No. PCT/US2012/027916, filed Mar. 6, 2012, which claims priority to U.S. Provisional Patent Application No. 61/449,851, filed on Mar. 7, 2011, U.S. Provisional Patent Application No. 61/506,483, filed on Jul. 11, 2011 and U.S. Provisional Patent Application No. 61/513,294, filed on Jul. 29, 2011, the disclosures of which are hereby incorporated by reference in their entirety.

FIELD OF THE INVENTION

The disclosure is directed generally to semiconductor manufacturing equipment. More specifically, the disclosure is directed to conditioning devices for the cleaning of polishing pads used in the manufacture of semiconductors.

BACKGROUND

Chemical mechanical planarization (CMP) is used extensively in the manufacture of semiconductor chips and memory devices. During a CMP process, material is removed from a wafer substrate by the action of a polishing pad, a polishing slurry, and optionally chemical reagents. Over time, the polishing pad becomes matted and filled with debris from the CMP process. Periodically the polishing pad is reconditioned using a pad conditioner that abrades the polishing pad surface and opens pores and creates asperities on the surfaces of the polishing pad. The function of the pad conditioner is to maintain the removal rate in the CMP process.

CMP represents a major production cost in the manufacture of semiconductor and memory devices. These CMP costs include those associated with polishing pads, polishing slurries, pad conditioning disks and a variety of CMP parts that become worn during the planarizing and polishing operations. Additional cost for the CMP process includes tool downtime in order to replace the polishing pad and the cost of the test wafers to recalibrate the CMP polishing pad.

A typical polishing pad comprises closed-cell polyurethane foam approximately 0.16 centimeters thick. During pad conditioning, the pads are subjected to mechanical abrasion in order to physically cut through the cellular layers of the pad surface. The exposed surface of the pad contains open cells, which can be used during the CMP process to trap abrasive slurry consisting of the spent polishing slurry and material removed from the wafer. In each subsequent pad-conditioning step, the pad conditioner removes the outer layer of cells containing the embedded materials and minimizes removal of layers below the outer layer. Over-texturing of the polishing pad results in a shortened life, while under-texturing results in insufficient material removal rate and lack of wafer uniformity during the CMP step.

One type of CMP pad conditioner is a four-inch disc with fixed diamond abrasives. The diamond coated disc is rotated and pressed onto the polishing pad surface to cut and remove the top layer. The diamonds are typically set in an epoxy or a metal matrix material. However diamonds from these pad conditioners can become dislodged which can lead to yield loss due to scratching of the wafer during the polishing operation.

There is a continuing need for CMP pad dressers that reduce or eliminate abrasive particles becoming dislodged and CMP pad dressers that have varying surface heights for dressing CMP polishing pads.

SUMMARY

In various embodiments of the invention, a pad conditioner machined from a substrate to have a desired distribution of feature heights and mesa roughness characteristics is provided. The pad conditioner is free of superabrasive particles such as diamond particles adhered to the substrate, eliminating the problem of particles being dislodged from a pad conditioner. Instead, the protrusions on the shaped ceramic act as geometric features that provide force concentrations on the pad surface. The cutting performance and longevity of these features is greatly enhanced by a polycrystalline CVD diamond coating that is grown over the surface protrusions. Versions of the present invention include a pad conditioner and methods of making the pad conditioner.

In one embodiment, the machining process capitalizes on the characteristics of a porous substrate material to provide the distribution and roughness characteristics. Because the features are machined from a substrate, the need to bond particles to a substrate is eliminated.

In one embodiment, the features are arranged in a predetermined pattern. The can be matrixical, that is, uniformly distributed in a repeating, matrix pattern. The features can include a bimodal or polymodal distribution of heights, wherein the various feature heights are interspersed.

Chemical mechanical planarization (CMP) is a process of smoothing surfaces with the combination of chemical and mechanical forces and periodically utilizes a pad conditioner to recondition the polishing pad. The function of the pad conditioner is to maintain the removal rate in the CMP process. The pad conditioner can also be referred to as a CMP polishing pad conditioner or a polishing pad conditioning head.

Pad conditioners that have a high density (number per unit area) of features of uniform height tend to produce a substantially uniform force per feature against a CMP polishing pad. Examples of such pad conditioners are disclosed, for example, by U.S. Pat. No. 6,439,986 to Myoung (Myoung) (disclosing machined features of uniform height); U.S. Patent Application Publication No. 2002/0182401 to Lawing (Lawing) (disclosing particle positioning using a temporary holding layer so that the particles define a uniform contact plane); U.S. Pat. No. 7,367,875 to Slutz et al. (Slutz) (disclosing a composite material on which a CVD diamond coating applied to a composite substrate of ceramic material and an unreacted carbide-forming material of various configurations). Other pad conditioners do not include protruding features, instead relying on surface roughness to accomplish the conditioning. See, e.g., EP 0540366A1 to Cornelius et al. (Cornelius) (disclosing a substrate comprised of bonded silicon carbide particles ranging in size from 2μιη to 50μιη, the substrate having a diamond layer bonded thereto); U.S. Pat. No. 6,632,127 to Zimmer et al. (Zimmer) (disclosing a substrate and a layer of fine-grain chemical vapor deposited polycrystalline diamond that is bonded onto the substrate, or, alternatively, thin sheet of polycrystalline diamond bonded to the CMP conditioning disk substrate). Such "protrusionless" substrates, when utilized as cutting surfaces on pad conditioners, also tend to produce substantially uniform forces across the cutting surface of the pad conditioner. Generally, a uniform force distribution such as produced by uniform protrusion heights and protrusionless surfaces also produces the lowest cut rate at standard operating pressures.

On the other hand, the forces generated on the proudest features of pad conditioners having irregularly shaped or oriented abrasive particles bonded to a base can result in the particles that experience the higher forces to become dislodged from the pad conditioner. See, e.g., U.S. Pat. No. 7,201,645 to Sung (Sung) (disclosing a contoured CMP pad dresser that has a plurality of superabrasive particles attached to the substrate); U.S. Patent Application Publication No. 2006/0128288 to An et al. (An) (disclosing a layer of metal binder fixing the abrasive particles to a metal substrate, with a diameter difference between smaller and bigger abrasive particles ranging from 10% to 40%). Dislodged particles can be captured by the polishing pad which can lead to scratching of the wafers during the polishing operation.

This conundrum can be overcome by a machining process that produces a pad conditioner having machined features of varying height. In one embodiment, the features are fabricated from an etching process that produces a polymodal distribution of feature heights. The porosity characteristics of the substrate material can also provide desired distribution characteristics; that is, a highly porous substrate or a substrate having a wider distribution of pore sizes will produce feature height populations over a broader range than denser substrates or substrates having a more uniform distribution of pore sizes. A porous substrate material can also provide features having peak regions or "mesas" that have a degree of roughness that also varies with pore size and pore size distribution.

In one embodiment, a chemical mechanical polishing pad conditioner that comprises a ceramic substrate that has a front surface and a back surface, the front surface of the ceramic substrate comprises or includes a first set of ceramic protrusions formed integrally from the ceramic substrate and a second set of ceramic protrusions formed integrally from the ceramic substrate, the first set of ceramic protrusions can be characterized by a first average height measured from a reference surface, and the second set of ceramic protrusions can be characterized by a second average height measured from the reference surface, the first average height being different from the second average height. In some versions of the invention the first set of ceramic protrusions and the second set of ceramic protrusions each have a top surface. The protrusions may further include a layer of polycrystalline diamond. In some versions of the pad conditioner the top of each protrusion in the first set of ceramic protrusions has a rough, non-flat surface and a top of each protrusion in the second set of ceramic protrusions has a rough, non-flat surface. The pad conditioner cuts a CMP pad to open pores and create asperities.

In some versions of the pad conditioner, the protrusions of each average height are formed in a repeatable pattern across a cutting surface of the pad conditioner. In another version of the pad conditioner the substrate includes ceramic protrusions of second average height that are smaller than the ceramic protrusions of first average height where the ceramic protrusions of second average height are located in an annular region near the outside edge of the substrate. In another version of the pad conditioner the substrate includes ceramic protrusions of two or more heights that are smaller than the ceramic protrusions of first average height where the smaller ceramic protrusions are located in an annular region near the outside edge of the substrate. The ceramic protrusions of lower profile allow the pad conditioner to ease into cutting of the polishing pad and reduces mechanical stress on these protrusions. In some versions of the invention the ceramic protrusions are silicon carbide; in other versions the protrusions are beta silicon carbide.

Some embodiments of the inventive pad conditioner include a substrate of one or more segments fixtured to a substrate. In some versions of the invention the one or more segments can each have the same protrusions, or the one or more segments can have the same combination of two or more protrusions in each segment. In other embodiments of the invention the segments can each have different protrusions or the segments can have different combinations of two or more protrusions.

In one embodiment, a chemical mechanical polishing pad conditioner includes a substrate with a front surface having a plurality of protrusions integral therewith, the plurality of protrusions extending in a frontal direction that is substantially normal to the front surface, each of the plurality of protrusions including a distal extremity. The plurality of protrusions include a subset of the plurality of protrusions having the distal extremities that are within a variance of a registration plane, the registration plane being substantially parallel to the front surface, the protrusions of the subset of the plurality of protrusions being located on the registration plane in a fixed and predetermined relationship relative to each other. A coating of polycrystalline diamond covers at least the distal extremities of the subset of the plurality of protrusions. The substrate has a porosity of at least 10%.

In another embodiment of the invention, each of the plurality of protrusions extend in the frontal direction about a respective registration axis that is normal to the front surface, each of the respective registration axes defining a predetermined location on the front surface of the substrate. The first subset of protrusions is identified by the predetermined locations on the front surface and define a first average height, the predetermined locations of the first subset of protrusions defining a first predetermined pattern. A second subset of protrusions is identified by the predetermined locations on the front surface, the predetermined locations of the second subset of protrusions defining a second predetermined pattern and a second average height that is less than the first average height. In one embodiment, at least a portion of the second subset of protrusions are interspersed amongst at least a portion of the first subset of protrusions, and a fraction of the second subset of protrusions have respective heights that are greater than the respective height of at least one of the first subset of protrusions.

In some embodiments, a chemical mechanical polishing pad conditioner includes a first subset of protrusions, each having a first base dimension that is substantially similar, the first subset of protrusions defining a first pattern and having a first average height. A second subset of protrusions, each having a second base dimension that is substantially similar, is also included, the second subset of protrusions defining a second pattern and having a second average height. In one embodiment, the first base dimension is greater than the second base dimension and at least a portion of the second subset of protrusions are interspersed amongst at least a portion of the first subset of protrusions.

In certain embodiments, each of the plurality of protrusions include a distal extremity, the plurality of protrusions including a first subset of protrusions having the distal extremities that are within a first variance centered about a first registration plane, the first registration plane being substantially parallel to the front surface, the protrusions of the first subset of protrusions being located on the substrate in a fixed and predetermined relationship relative to each other. A second subset of protrusions have distal extremities that are within a second variance centered about a second registration plane, the second registration plane being substantially parallel to the front surface, the protrusions of the second subset of protrusions being located on the substrate in a fixed and predetermined relationship relative to each other. In one embodiment, at least a portion of the second subset of protrusions being interspersed amongst at least a portion of the first subset of protrusions. Each of the second subset of protrusions can include a root-mean-square surface roughness that is greater than 3μη.

In various embodiments, each of a plurality of protrusions include a distal extremity located on a mesa of the respective protrusion, the mesa defined as being within a predetermined distance from the distal extremity of the respective protrusion in a direction opposite the frontal direction. Each of the plurality of protrusions define a cross-section at the base of the mesa, the cross-section defining a centroid. For at least a portion of the plurality of protrusions, the centroid of the cross-section is offset from the respective registration axis.

While several exemplary articles, compositions, apparatus, and methods of making the pad conditioner are shown, it will be understood, of course, that the invention is not limited to these versions. Modification may be made by those skilled in the art, particularly in light of the foregoing teachings. For example, steps, components, or features of one version may be substituted for corresponding steps, components, or features of another version. Further, the pad conditioner may include various aspects of these versions in any combination or sub-combination.

BRIEF DESCRIPTION OF THE DRAWINGS

FIG. 1 is a perspective view of a wafer polishing apparatus with a conditioner in an embodiment of the invention;

FIGS. 2 A-2C are sectional views of pad conditioners in embodiments of the invention;

FIGS. 3A and 3B are sectional views of pad conditioners in embodiments of the invention;

FIG. 3C is a partial perspective view of a pad conditioner in an embodiment of the invention;

FIG. 3D is a magnified image of a portion of a pad conditioner in an embodiment of the invention;

DETAILED DESCRIPTION

Figure 4A:
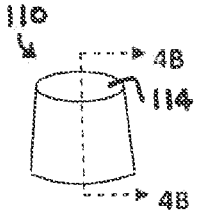
FIG. 4A (Prior Art)
FIGS. 4A and 4B are perspective and sectional views of a protrusion of the prior art.

Referring now to FIG. 1, a wafer polishing apparatus 30 with a pad conditioner 32 in a chemical mechanical planarization (CMP) process is depicted in an embodiment of the invention. The depicted wafer polishing apparatus 30 includes a rotation table 34 having an upper face 36 with a CMP pad 38 (such as a polymeric pad) mounted thereon. A wafer head 42 having a wafer substrate 44 mounted thereon is arranged so that the wafer substrate 44 is in contact with the CMP pad 38. In one embodiment, a slurry feed device 46 provides an abrasive slurry 48 to the CMP pad 38.

In operation, the rotation table 34 is rotated so that the CMP pad 38 is rotated beneath the wafer head 42, pad conditioner 32 and slurry feed device 46. The wafer head 42 contacts the CMP pad 38 with a downward force F. The wafer head 42 can also be rotated and/or oscillated in a linear back-and-forth action to augment the polishing of the wafer substrate 44 mounted thereon. The pad conditioner 32 is also in contact with the CMP pad 38, and is translated back and forth across the surface of the CMP pad 38. The pad conditioner 32 can also be rotated.

Functionally, the CMP pad 38 removes material from the wafer substrate 44 in a controlled manner to give the wafer substrate 44 a polished finish. The function of the pad conditioner 32 is to remove debris from the polishing operation that fills the debris from the CMP process and to open the pores of the CMP pad 38, thereby maintaining the removal rate in the CMP process.

Referring to FIGS. 2A through 2C (referred to collectively as FIG. 2), pad conditioners 52*a*, 52*b* and 52*c* are depicted in embodiments of the invention (referred to collectively as pad conditioners 52). The pad conditioners 52 can include a substrate 54 with a back surface 56 and a front surface 58 opposite the back surface. The front surface 58 of the substrate 54 can include a first set of protrusions 62 and a second set of protrusions 64. The first set of protrusions 62 are integrally formed on the substrate 54 and have a first average height centered about a plane PI that can be measured from the back surface 56 of the substrate 54 to the distal surfaces 66 of the first set of protrusions 62. The second set of protrusions 64 are also integrally formed on the substrate 54 and can have a second average height centered about a plane P2 as measured from the back surface 56 of the substrate to the distal surfaces 68 of the second set of protrusions 64. In the depicted embodiments of FIG. 2, the first and second sets of protrusions 62 and 64 can be distinguished from each other as having differing average heights.

The first and second sets of protrusions 62 and 64 are integral with the substrate 54, not abrasive particles bonded to the substrate. In some versions of the invention the distal surfaces 66 of one or more protrusions in the first set of protrusions 62 can have an irregular or roughened surface, and the distal surfaces 68 of each protrusion in the second set of protrusions 64 can have an irregular or roughened surface. The first set of protrusions 62 and the second set of protrusions 64 can be coated on at least their top surfaces with a coating of, for example, polycrystalline diamond.

In one embodiment, the roughness or irregular surface at the distal surfaces 66 and 68 of the protrusions can be attributed at least in part to the roughness from a porous graphite substrate that was converted to silicon carbide. In other versions of the invention the top of one or more protrusion in the first set of protrusions can have a flat surface, and a top of each protrusion in the second set of protrusions can have a flat surface.

The average height of the first set of protrusions 62 can define a first plane PI and the average height of the second set of protrusions 64 can define a second plane P2. In one embodiment, the first and second planes PI and P2 are substantially parallel to each other. Without limitation, additional sets of protrusions, for example a third set of protrusions (not depicted) having an average height, a fourth set of protrusions having an average height, and the like, can also be formed on the surface of the substrate or a segment 54. The back surface 56 of the substrate 54 can be joined or coupled to conditioning equipment.

In certain embodiments, the first set of protrusions 62 has an average height that is greater than the average height of second protrusions 64. That is, plane PI is further from the back surface 56 of the substrate 54 than plane P2. In various embodiments, the substrate or segment 54 of the pad conditioner is a ceramic material. In some versions of the pad conditioner the ceramic material comprises silicon carbide. The ceramic material can, for example, be a beta silicon carbide or a ceramic material comprising beta silicon carbide, which can include a separate carbon phase or excess carbon.

In one embodiment, a method of making the pad conditioner from a near net shape porous graphite precursor is implemented. A graphite block can be machined into a near-net shape of the pad conditioner 52 substrate or segment 54. Herein, "near-net shape" is used to indicate a component that involves minimal post-process machining to achieve final form and tolerances. In one example, a porous graphite substrate is textured to form protrusions and other features such as channels using one of several forming processes. The textured graphite substrate can then be converted to near net shape silicon carbide material substrate. The near net shaped silicon carbide can be a beta silicon carbide. Forming the pad conditioner 52 by converting a near net shaped porous graphite precursor to a near net shaped silicon carbide pad conditioner 52 can provide cost advantages over texturing silicon carbide directly, because machining silicon carbide is a difficult and time-consuming process due to its hardness.

The FIGS. 2A through 2C show non-limiting examples of pad conditioners 52 in cross section in embodiments of the invention. In these examples the pad conditioner substrates 54 have an axis of rotation and the back surface 56 is parallel to one or more planes defined by the average height of the first and second set of protrusions 62 and 64 on the front surface 58 of the substrate 54. The two planes PI and P2 of the pad conditioner effectively define two cutting planes. In some versions the substrate may include more that two cutting planes.

The protrusions can be formed in the front surface of the substrate (FIG. 2A or FIG. 2C), or the protrusions may be formed in a second substrate 72 that is joined to a first substrate (FIG. 2B), or the protrusions can be formed on one or more substrates that are separate segments, the segments being joined to a backing plate (see FIG. 7 and attendant discussion). Depending on the configuration of the pad conditioner 52, the substrate with protrusions or the first substrate is coupled to a rotating and/or translating apparatus (not shown) of the conditioning equipment. The substrate can have a wide range of shapes and is not limited to the shape of a disk. The substrate can have an axis of rotation for rotation in a plane.

Referring to FIGS. 3 A through 3D (referred to collectively as FIG. 3), pad conditioners 80 having edge regions 82 and central regions 84 are depicted in embodiments of the invention. In FIG. 3A, the edge region 82 includes a plurality of protrusions 86 (FIG. 3A) or a single protrusion 87 (FIG. 3C) having an average height centered about plane P2 that is of a height that is less than at least some of the protrusions 88 of the central region 84. The protrusions 86 and 88 are formed in regions or fields across the substrate or segment. In the depicted embodiment, the protrusions 86 and/or 88 can be a series of individual pedestals or can form continuous annular rings that surround the central region 84.

In the embodiment of FIG. 3D, a single edge field protrusion 92 comprises a large platform 94 that is adjacent a field of pedestal protrusions 96. In the image of FIG. 3D, the pedestal protrusions 96 are about 65μιη in base dimension, about 65μιη in height and have a density of about 3 protrusions per square millimeter. The large platform 94 has a width (distance from datum (b) to datum (c) in FIG. 3C) that is about 400μιη with an average height of about 40μιη.

With respect to FIG. 3B, an edge 102 of the conditioning substrate or segment 80 has smaller height pyramidal shaped cutting features 104 while an inner field of the substrate or segment has taller height truncated square pyramidal protrusions 106 (irregular top surface not shown).

The protrusions are separated by recessed areas which can be in the shape of channels with varying cross sections such as but not limited to a square shape, a "U" shape, or a "V" shape. In some embodiments the side and bottom regions of recessed channels have a rounded shape that narrows at the bottom or valley extremity 108, providing the protrusions a broader and thicker base dimension for increased strength. In FIG. 3C, for example, the protrusion 87 of the edge region 82 can form an annular ring on the substrate surface defining the plane P2 as laying between the substrate base and the plane PI of the central region.

Figure 4B:
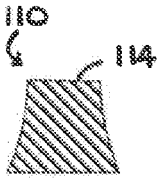
FIG. 4B (Prior Art)
Figure 4C:
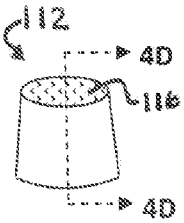
FIGS. 4C and 4D are perspective and sectional views of a protrusion of an embodiment of the invention.
Figure 4D:
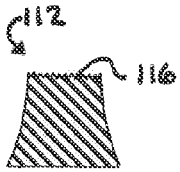

Referring to FIGS. 4A through 4D, a protrusion 110 of the prior art (FIGS. 4A and 4B) is compared with a protrusion 112 of an embodiment of the invention (FIGS. 4C and 4D). The protrusion of FIG. 4A includes flat surface 114, a cross-section of which is depicted in FIG. 4B. In contrast, the protrusion 112 of FIG. 4C includes an irregular or textured top surface 116, with cross-section depicted in FIG. 4D.

Figure 5A:
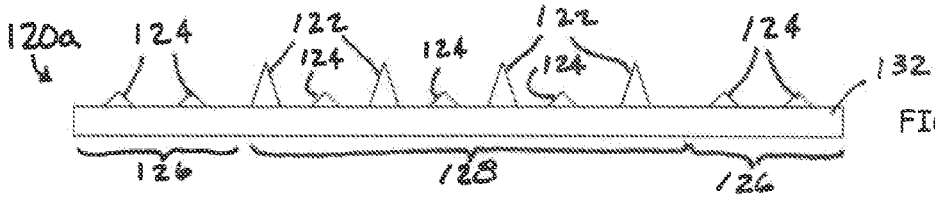
FIGS. 5A and 5B are schematic sectional views of pad conditioners or segments of the invention.
Figure 5B:
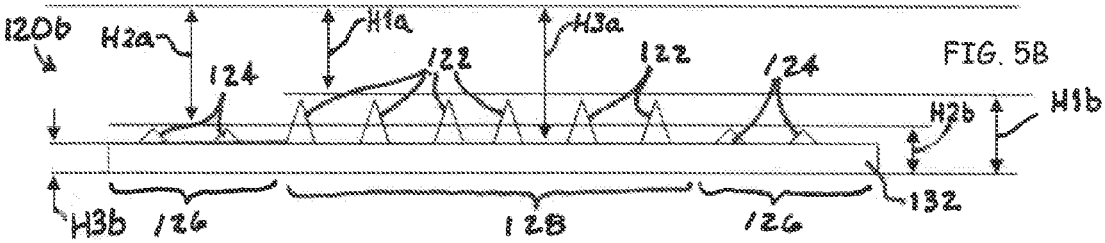

Referring to FIGS. 5A and 5B (referred to collectively as FIG. 5), pad conditioners 120*a* and 120*b*, respectively, having protrusions 122 of a first average height and protrusions 124 of a second average height are formed in a pattern across an edge region 126 and/or a central or field region 128 of a substrate or segment 132 in an embodiment of the invention. The protrusions 122, 124 can have a variety of shapes that provide cutting regions on the CMP pad. In some embodiments the protrusions 122, 124 have geometrical shapes such as but not limited to pyramidal, conical, rectangular, cylindrical, as well as truncated versions thereof having plateaus (e.g., frustroconical). The distal surfaces of the protrusions 122, 124 can have a square edge, a rounded edge, or edges that are broken with a radius. For example, FIG. 5 depict the substrate 132 as having a repeatable pattern of taller pyramidal or cone shaped protrusions (protrusions 122) in a center region 128 of the substrate 132 and smaller pyramidal or cone shaped protrusions (protrusions 124) at an outer or annular edge region 126 of the substrate, as well as being interspersed amongst the taller protrusions 122. The taller protrusions 122 depicted in FIG. 5A allows the pad conditioner 120 to aggressively penetrate the CMP polishing pad while the smaller protrusions 124 prevent over conditioning with large burrows which can lead to agglomeration defects. The FIG. 5B depicts the taller field protrusions 122 and smaller lead in protrusions in the edge regions 126. The uniform features in the field provide a smoother texture to the polishing pad (item 38 of FIG. 1) that is advantageous to metal processes such as copper CMP.

In certain embodiments, the substrate, segment or a second substrate will have protrusions with two or more different average heights. The heights of the protrusions can be measured from a back surface of the substrate or segment, or from some arbitrary reference plane. Protrusions that are the same average height can be used to define a cutting plane or a cutting region for the pad conditioner. A pad conditioner can have two or more cutting planes. For example, referring again to FIG. 3A, two sets of protrusions with different average heights are shown and each of the protrusions has a textured or irregular top surface. Those protrusions with the same average height PI will have top surfaces that lie in a first plane, and these protrusions are higher than the protrusions whose top surfaces have an average height P2 that lie in a second plane. In some versions of the invention the first plane is parallel to second or third planes.

Protrusion heights and/or largest aspects of a top surface, in some cases width or diameter of a top surface, can range from 10 microns to about 200 microns, and in some embodiments from 10 to 100 microns. Where the protrusions are sharp point like features, the protrusions can be characterized by a largest aspect at half height of the protrusion.

The reference plane can be the back of the substrate, or in a case where the back of the substrate is non-planar (for example, concave or convex, or other) an external reference plane parallel to the top surfaces of three or more protrusions can be used. For example, referring again to FIG. 5B, depending upon the reference plane use to characterize the sets of protrusions, the tallest protrusions can be characterized by an average height HI a or H1b (external reference plane or back of substrate respectively), the smaller protrusions near the edge region of the substrate can be characterized by an average height H2a or H2b (external reference plane or back of substrate respectively) and the surface channels and gaps between the sets of protrusions can be characterized by an average height H3a or H3b (external reference plane or back of substrate respectively).

Referring to FIGS. 6 A through 6F (referred to collectively as FIG. 6), various non-limiting examples of configurations with different "protrusion densities" are illustrated in embodiments of the invention. "Protrusion density" is herein defined as a number or protrusions per square unit of area. Non-limiting examples of the protrusion density can range from 0.1 protrusions per square millimeter (i.e., one protrusion per 10 $mm^2$ of area) to 50 protrusions per square millimeter. Generally, a lower density of protrusions can be used to apply more force per unit area to the CMP pad and cut the pad more aggressively than a higher density of protrusions. Protrusions with pointed top surfaces also tend to apply more force per unit of contact area to the CMP pad and cut the CMP pad more aggressively than protrusions with flattened, rounded, or radius top surfaces.

Herein, "centrally located protrusions" refers to a subset of protrusions located in a field region or an area of the substrate or segment proximate a center point or center of mass of the substrate (or segment), the subset of protrusions extending toward one or more edges of the substrate. "Peripherally located protrusions" refers to protrusions located in an edge region of the substrate or segment that originate at a leading edge or rim of the substrate and extend inwardly. In some embodiments of the invention, the area of the peripherally located protrusions can be between 0.5% and 75% of the area of the substrate, in other versions the area of peripherally located protrusions can be between 10% and 35% of the area of the substrate.

Figure 6A:
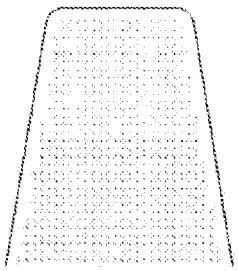
FIGS. 6A-6F are partial plan views of segments of the invention.
Figure 6B:
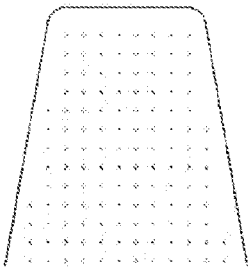
Figure 6C:
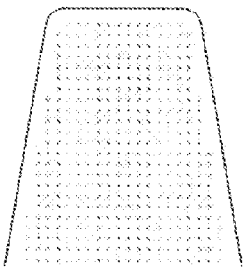
Figure 6D:
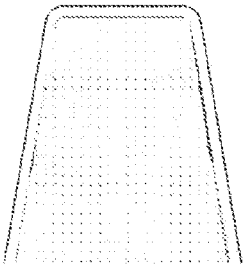
Figure 6E:
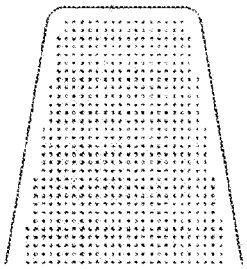
Figure 6F:
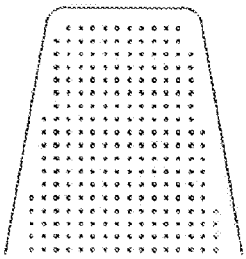

Referring again to FIG. 6, the sizes (base dimensions) of the protrusions, densities of the protrusions, and resulting protrusions per segment illustrated in the depictions above are as follows: protrusions with base dimensions of 85 um, density of 5 protrusions per square millimeter, and 1460 protrusions per segment (FIG. 6A); protrusions of 125μιη base dimension, 1 protrusion per square millimeter, and 290 protrusions per segment (FIG. 6B); interspersed protrusions of 125μιη and 85μιη base dimensions, 3 protrusions per square millimeter, with 495 125-μιη base dimension protrusions and 375 85-μιη base dimension protrusions per segment (FIG. 6C); protrusions of 65μιη base dimension with a lead in edge, 3 protrusion per square millimeter absent the lead in edge, and 880 protrusions per segment (FIG. 6D); 125μιη base dimension protrusions, 5 protrusions per square millimeter, and 1460 protrusions per segment (FIG. 6E); and 200μιη base dimension protrusions, 2 protrusions per square millimeter, and 585 protrusions per segment (FIG. 6F).

Referring to FIGS. 7A through 7D, pad conditioner assemblies 150*a*, 150*b* and 150*c* are depicted in embodiments of the invention. The pad assemblies 150*a*, 150*b* and 150*c* (collectively referred to as pad assemblies 150) include conditioning segments 152*a*, 152*b* and 152*c*, respectively (collectively referred to as conditioning segments 152), affixed to an underlying substrate or backing plate 154. The conditioning segments 152 can have protrusions of two or more different average heights, as discussed for various embodiments above (e.g., FIGS. 2, 3 and 5). In one embodiment, the segments are bonded to the backing plate 154 using an adhesive such as an epoxy.

Figure 7A:
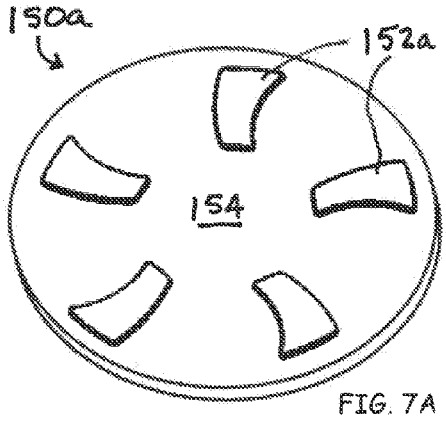
FIGS. 7A-7C are perspective views of pad conditioners having segments in embodiments of the invention.
Figure 7B:
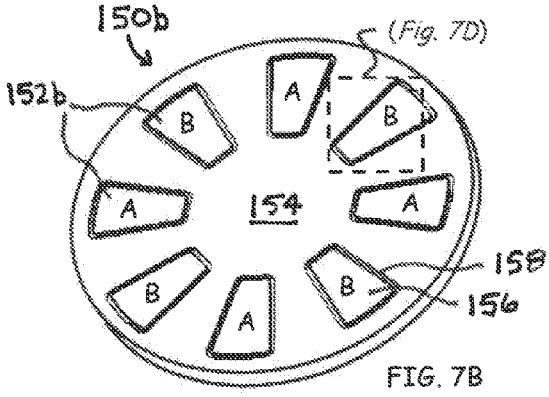
Figure 7C:
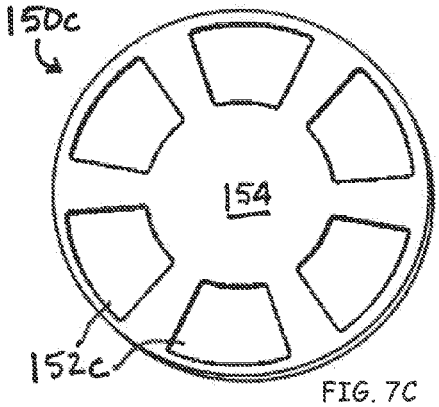
Figure 7D:
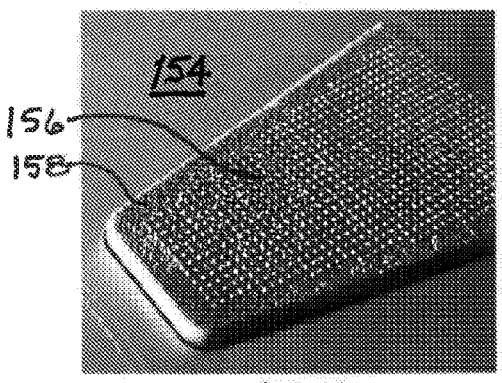
FIG. 7D is an magnified image of a section mounted to the backing plate of FIG. 7B.
Figure 7E:
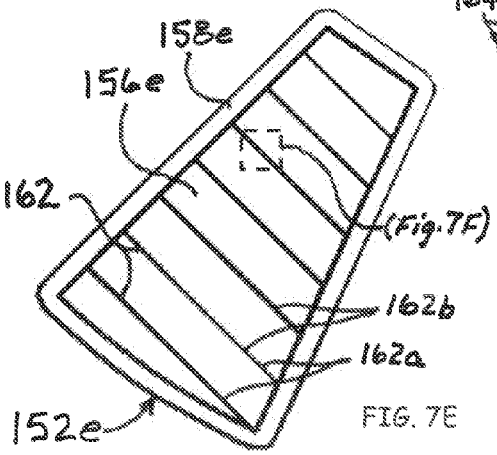
FIG. 7E is a plan view of a section having grooves or ditches in an embodiment of the invention.

Each conditioning segment 152 can include a central or field region 156 and one or more edge regions 158 having different protrusion characteristics or no protrusions at all, as best depicted in FIGS. 7B, 7D and 7E. In one embodiment, the edge region 158 of at least some of the segments can be comprised of protrusions having a lower height than the protrusions of the central region 156 (e.g., FIG. 5), providing a reduced force and shear on the protrusions of the edge region 158.

Figure 7F:
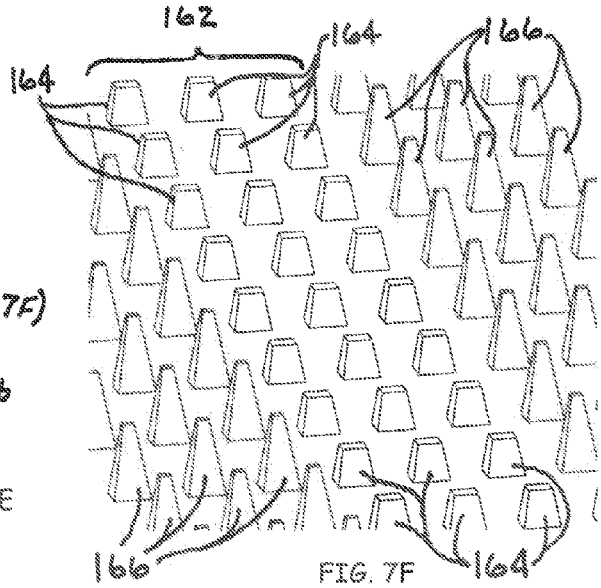
FIG. 7F is an enlarged perspective view of a portion of a groove or ditch of FIG. 7E.

Referring to FIGS. 7E and 7F, a segment 152*e* includes an edge region 158*e* and a central or field region 156*e*, with the field region 156*e* including grooves or ditches 162 wherein the protrusions are of substantially reduced height or, alternatively, have no protrusions at all. The grooves or ditches 162 are depicted in FIG. 7F as a band of truncated square pyramidal protrusions 164 amidst taller truncated square pyramidal protrusions 166. The regions between the ditches 162 can also be of differing characteristics; that is, a zone between a first pair of ditches 162*a* can have different characteristics that a zone between a second pair of ditches 162*b*, such as differing patterns, protrusion heights, protrusion densities and/or feature roughnesses.

Functionally, the lower heights of the features in the edge regions 158 can aid in debris removal during the dressing process. Having pedestal protrusions or annular protrusions that define the plane P2 as laying between the substrate base and the plane PI of the central region (e.g., FIGS. 3C and 5B) acts to reduce stress on the features located at the edge region 158 of the conditioning segments 152. Regions of smaller and/or shorter protrusions, such as the ditches or grooves 162 of conditioning segment 152*e* can also provide relief or removal of pad debris and slurry.

The one or more conditioning segments 152 can each have the same, uniform protrusion profile, or the one or more conditioning segments 152 can have the same combination of two or more groups of protrusions in each conditioning segment 152. The conditioning segments 152 can also each have uniform protrusion profiles on a given segment, but that differ between segments. In another embodiment, the conditioning segments 152 can have different combinations of varying protrusion profiles. A non-limiting example is to have edge and field regions 128, 126 of FIG. 5A as the edge and field regions 158, 156 of conditioning segments 152*b* at the positions labeled "A" in FIG. 7B, and to have segments edge and field regions 128, 126 of FIG. 5B as the edge and field regions 158, 156 of conditioning segments 152*b* at the positions labeled "B" in FIG. 7B.

The various pad conditioners, pad conditioner assemblies and conditioning segments depicted herein are not limited in their size or area, but can for example be made in a standard 4 inch diameter disc configuration. In some embodiments assemblies the backing plate 154 is joined to the conditioning apparatus. The backing plate 154 is usually in the form of a disk ranging in diameter from about 2 to 4 inches; however, other shapes and sizes may be used as the backing plate 154 for pad conditioners or conditioning segments. The thickness of the backing plate 154 can range from about 0.05 to about 0.5 inch, and optionally in a range of 0.05 to 0.15 inch.

Figure 8A:
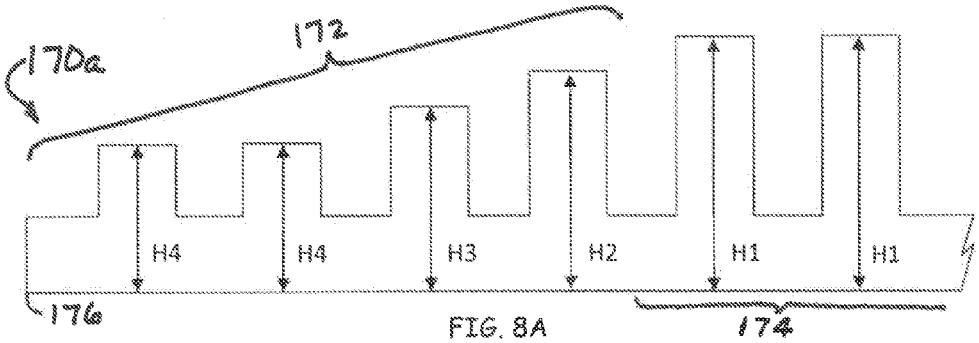
FIGS. 8A-8C are partial sectional views of edge regions of a pad conditioner or section having monotonically increasing protrusion heights in embodiments of the invention.
Figure 8B:
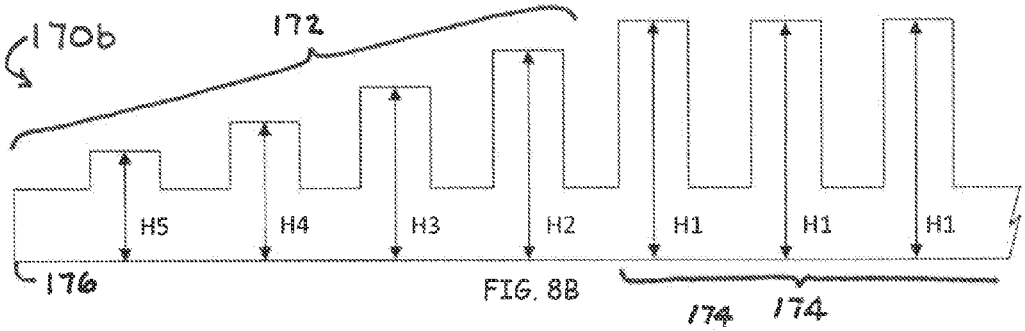
Figure 8C:
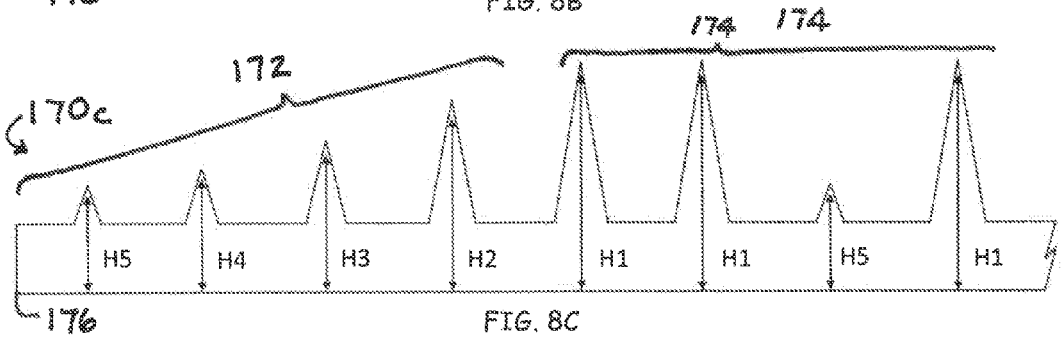

Referring to FIGS. 8A through 8C (referred to collectively as FIG. 8), pad conditioners or segments 170*a*, 170*b* and 170*c* (referred to collectively as pad conditioners 170) are depicted in embodiments of the invention. The pad conditioners 170 having edge regions 172 with protrusions that increase monotonically in height across the edge region 172 towards a central region 174. For example, FIG. 8A depicts a portion of the pad conditioner 170*a* where two or more protrusions or rows of protrusions of height H4 proximate an edge 176 of the substrate have a lower height, with protrusion heights monotonically increasing towards the central region 174, as illustrated by heights H3 and H2, with the final highest height HI being in the central region 174. In FIG. 8B, the edge region 172 of the pad conditioner 170*b* has protrusion heights that monotonically increase in height from H5 proximate the edge 176 of the substrate to heights H4, H3 and H2 toward the middle of the pad conditioner 170*b* to a final height of HI in the central region 174. In FIG. 8C, the pad conditioner 170*c* is depicted as having protrusion heights that increase monotonically from a height of H5 proximate the edge 176 of the pad conditioner 170*c* to heights of H4, H3 and H2 towards the central region 174 of the substrate to a height HI. The protrusions in the central region 174 of FIG. 8C are depicted as having different heights such as but not limited to HI and H5. The illustrated embodiments of FIG. 8 can include protrusions or rows of protrusions across the edge region 172 of greater or lesser number, and/or different combinations of protrusion types and shapes across the edge region 172.

In some embodiments, the average height of a first set of pedestal protrusions is constant or substantially constant about a first annular zone overlying a portion of three or more rows of a first set of protrusions, the average height of the second set of protrusions being constant or substantially constant about a second annular zone overlying a portion of three or more rows of a second set of protrusions, and the average height of the first set of protrusions changes to the average height of the second set of protrusions in an annular region of the substrate or along a radial axis that is perpendicular to the rotational axis of the pad conditioner.

Functionally, the monotonically increasing heights of the protrusions in the edge region 172 enable easing of the pad conditioner 170 (i.e., pad conditioner 32 of FIG. 1) into the CMP pad 38. Having pedestal protrusions or annular protrusions of monotonically increasing height from the outer edge 176 towards the center of the pad conditioner 170 enables the pad conditioner 170 to transition into the cutting of the CMP pad 38 and reduces stress on the features located in the edge region 172 of the pad conditioner 170.

In certain embodiments, the surfaces of the various substrates and protrusions are irregular or have a randomly textured, uneven and/or roughened surface, at least on the portion of the pad conditioner 32 that contacts the CMP pad 38 (FIG. 1) during the reconditioning process. These surface characteristics can result from the conversion of a porous near net shaped graphite substrate to silicon carbide. In some cases the irregular texture of the substrate surface is due to a combination of the porosity of the starting graphite substrate and the shaping or machining method used to make the protrusions and other features of the near net shaped graphite. In other embodiments, the distal surfaces of the protrusions are flat. A substrate material with one or more protrusions, and with either a flat or rough surface, may be used as a pad conditioner.

Various embodiments of the pad conditioners described herein can be used with an application force F (FIG. 1) in the range, by non-limiting example, of about 2 to 10 pounds-force (lbf). Depending on the configuration, the various pad conditioners of the present invention can achieve a cut rate of a CMP pad at these application forces of about 5μιη to about 60μιη per hour, or with some configurations a cut rate in the range of about 20μιη to about 40μιη per hour, or in still other, more aggressive configurations a cut rate ranging from about 40μιη to about 60μιη per hour. The cut rate of a pad can be measured by the methods disclosed, for example, in "Standardized Functional Tests of Pad Conditioners," Vishal Khosla, et al, pages 589-592, Proceedings, Eleventh International Chemical Mechanical Planarization for ULSI Multilevel Interconnection Conference (CMP-MIC Conference), Feb. 21-23, 2006, Fremont Calif., Library of Congress No. 89-644090, the contents of which are incorporated herein by reference in their entirety except for express definitions contained therein.

Figure 9:
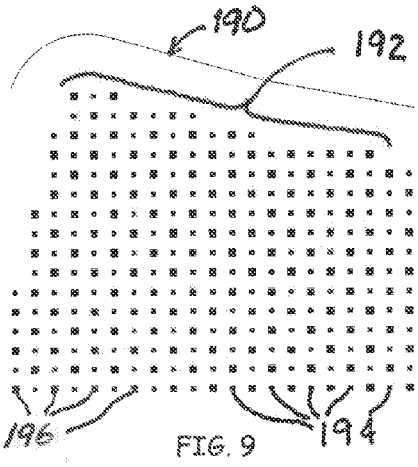
FIG. 9 is a partial view of a section having interspersed protrusions of different base dimensions in an embodiment of the invention.

Referring to FIG. 9, a pad conditioner or conditioning section 190 having interlaced or interspersed protrusions 192 of different size is depicted in an embodiment of the invention. Example protrusion sizes are 85μιη base dimension (denoted by numerical reference 194) and 125μιη base dimension (denoted by numerical reference 196). The 125μιη-sized protrusions 196 define a pattern that is matrixical (i.e., uniformly distributed in a repeating, matrix pattern). Likewise, the 85μιη-sized protrusions 194 define a pattern that is matrixical and is interspersed amongst the pattern formed by the 125μιη-sized protrusions 196.

Figure 10:
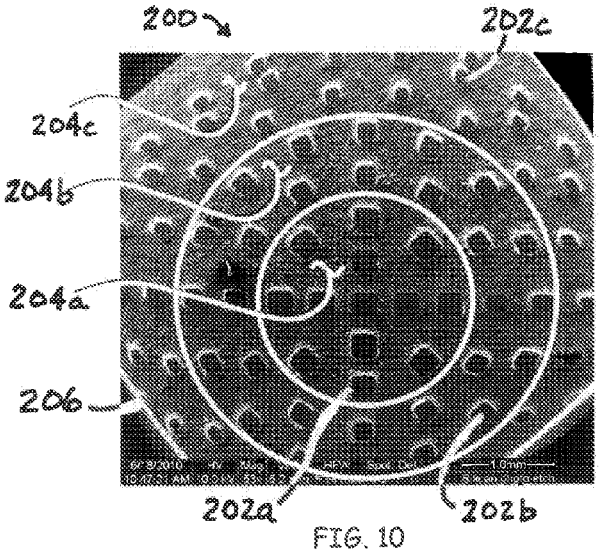
FIG. 10 is a magnified image of a conditioning head having protrusions of different base dimensions in an embodiment of the invention.

Referring to FIG. 10, a scanning electron microscope (SEM) image 200 of an embodiment of the invention is presented, wherein the protrusions 202*a*, 202*b* and 202*c* have variable base dimensions and patterns on the substrate. In this embodiment, protrusions 202*a* having larger base dimensions define a pattern that occupies a central zone 204*a* of a conditioning head 206, protrusions 202*b* having mid base dimensions occupy an intermediate zone 204*b* of the conditioning head, and protrusions 202*c* having smaller base dimensions occupy an outer zone 204*c* of the conditioning head. In this particular embodiment, the different base-dimensioned protrusions 202*a*, 202*b* and 202*c* are not interspersed or interlaced.

Referring to FIGS. 11A through 11D, a substrate 210 having first and second sets of protrusions 212 and 214 integral therewith and extending in a frontal direction 216 is depicted in an embodiment of the invention. In this embodiment, the first set of the protrusions 212 are nominally at one average height HI and the second set of protrusions 214 are nominally at a second average height H2 (FIG. 1 IB) the average height HI being greater than the average height H2. The "frontal direction" 216 is a direction substantially normal to and extending away from a front surface or "floor" 218 of the substrate 210. The first set of protrusions 212, being of nominally greater height, are alternatively referred to herein as "major protrusions." The second set of protrusions 214, being of nominally lesser height, are alternatively referred to as "minor protrusions."

Each of the protrusions of the first and second sets 212 and 214 can be characterized as having a distal extremity 215 (FIG. 1 IB). The first set of protrusions 212 can have distal extremities 215 that are within a first variance 220 of a first registration plane 222, the first registration plane 222 being substantially parallel to the front surface 218. Herein, a "variance" is defined as a height difference between the highest and the lowest distal extremity of a set of protrusions, the height being defined as normal to a registration plane. In one embodiment, the first set of protrusions 212 are located proximate the first registration plane 222 in a fixed and predetermined relationship relative to each other.

The second set of protrusions 214 can include distal extremities 215 that are within a second variance 226 of a second registration plane 228, the second registration plane 228 being substantially parallel to the front surface 218, the second set of protrusions 214 being located on the second registration plane 228 in a fixed and predetermined relationship relative to each other.

The first and second registration planes 222 and 228 are also referred to, respectively, as the "upper" and "lower" registration planes, "upper" meaning that it is furthest from the floor 218 of the substrate 210. It is noted that the first set of protrusions 212 extend through the second ("lower") registration plane 228; therefore, there can also be in a fixed and predetermined relationship between the first and second sets of protrusions 212 and 214 on the second registration plane 228.

The first registration plane 222 can be characterized as being nominally offset from the second registration plane 228 in the frontal direction 216 by an offset distance 232 that is greater than either the first variance 220 or the second variance 226. The offset distance 232 can be characterized as being greater than a multiple or factor of either variance 220 or 226, or as a fixed dimension or range of dimensions. A typical and non-limiting range of dimensions for the variances 220, 226 is 5μιη to 50μιη. In some embodiments, the variances 220, 226 can range from 10μιη to 25μιη. The variances 220, 226 can also be characterized as being greater than a minimum value and less than a maximum value. Typical and non-limiting multiples or factors of the variances 220, 226 for the offset distance 232 is greater than 1 or 2. Typical and non-limiting values for the offset distance 232 range from 10μιη to 80μιη.

Figure 11A:
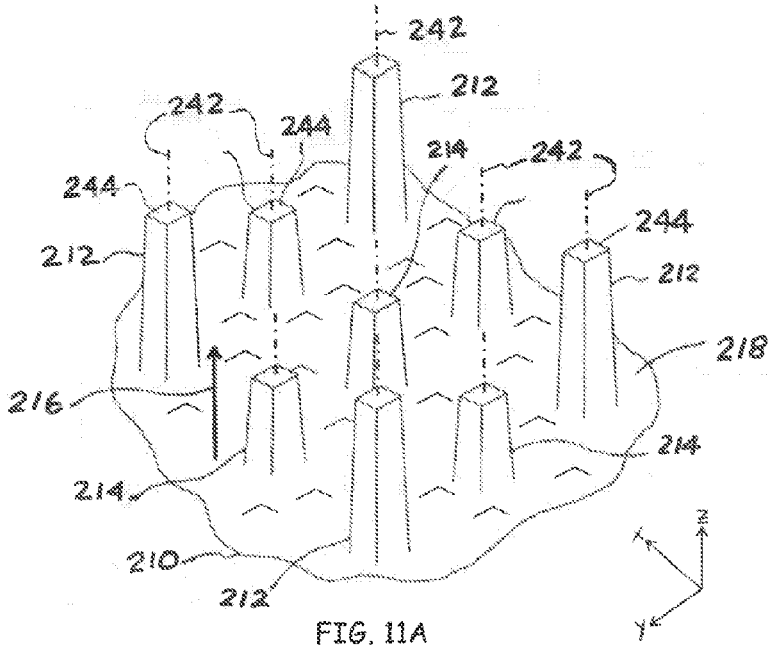
FIG. 11A is an enlarged partial perspective view of a pad conditioner having protrusions of different heights interspersed in an embodiment of the invention.
Figure 11B:
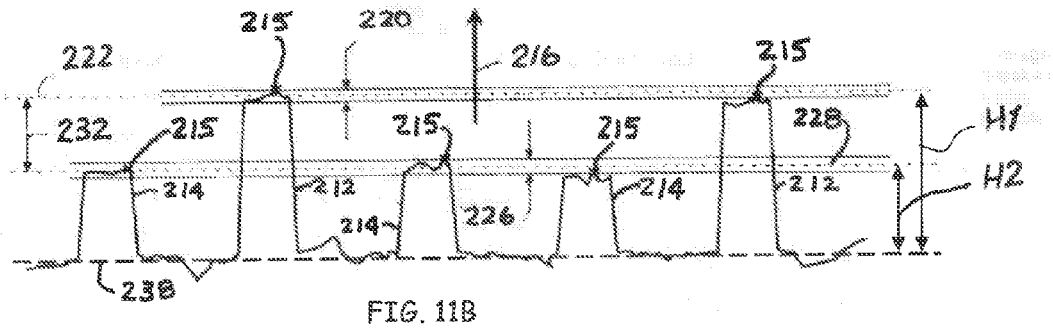
FIG. 11B is an enlarged sectional view of a pad conditioner having protrusions of different heights interspersed in an embodiment of the invention.

In one embodiment, the first and second average heights HI and H2 of the respective first and second sets of protrusions 212 and 214 are average "peak-to-valley" heights (depicted in FIG. 11B). A peak-to-valley height of a protrusion is defined as the average distance between the distal extremity 215 and a nominal floor datum plane 238. The nominal floor datum plane 238 is a plane that passes through the median level of the floor 218. The fabrication process utilized can result in surfaces that are unevenly machined, such that the floor 218 can possess a high degree of roughness and randomness, making the median level difficult to determine. Accordingly, one way of characterizing the average peak-to-valley height of the protrusions is to establish a minimum average peak-to-valley height for the major protrusions and a maximum average peak-to-valley height for the minor protrusions. Such characterization can allow for a high level of uncertainty in terms of the location of the floor datum plane 238. Another method of characterization is to determine a "prominence height" of each protrusion, discussed in relation to FIG. 16 below.

One way to characterize the fixed and predetermined relationship between the protrusions of a given protrusion set (e.g., first protrusion set 212 or second protrusion set 214) is to define "registration axes" 242. A "registration axis" 242 is an axis that passes through a protrusion in the frontal direction 216, and can be ascribed a precise location on the substrate 210. Depending on the fabrication process, a given protrusion may or may not be substantially centered about the respective registration axis 242. That is, a fabrication process that implements, for example, laser machining can produce protrusions that are centered about the registration axes within a small tolerance. On the other hand, a fabrication process that implements, for example, an abrasion machining technique, may produce protrusions having cross-sections with centroids that are substantially offset from to the respective registration axis, particularly at cross-sections that are proximate the distal extremity.

The latter case is depicted in FIG. 1 ID, which depicts the registration axes 242 on a matrixical grid 246 and hypothetical cross-sections of the first and second sets of protrusions 212 and 214 proximate the lower registration plane 218. Note that, while the registration axes 242 pass through the protrusions, they are not necessarily centered within the protrusions. The offset is explicitly depicted on a cross-section 212*a* of one of the protrusions 212 of FIG. 11D, which presents a centroid 243 of the cross-section 212*a* that is offset from the respective registration axis 242. The cross section 212*a* is also characterized as having a major dimension 241 (i.e., the longest dimension of the cross-section). In some embodiments, the centroid 243 is offset from registration axis 242 by a distance that is at least 5% of the major dimension 241.

Figure 11D:
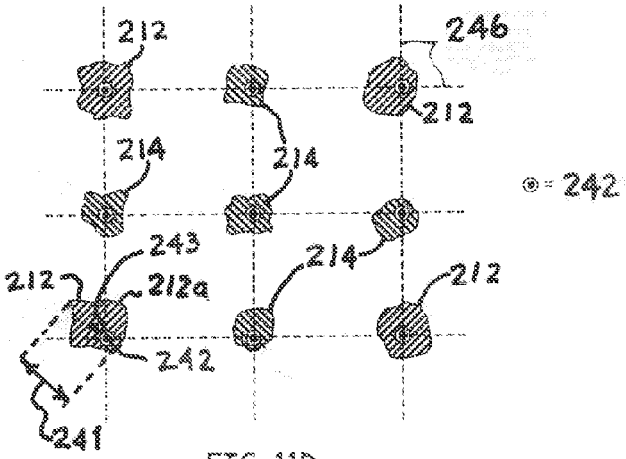
FIG. 11D is an enlarged sectional view at a plane that cuts through a series of protrusions in an embodiment of the invention.
Figure 11C:
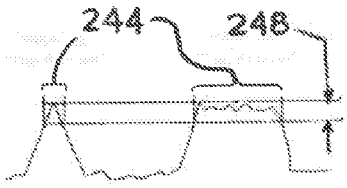
FIG. 11C is an enlarged sectional view of protrusions having mesas in an embodiment of the invention.

In one embodiment, the protrusions of the first and/or second set 212 and/or 214 are in a matrixical arrangement (i.e., uniformly distributed in a repeating, matrix pattern) over at least a portion of the substrate 210, as depicted in FIG. 11D. In other embodiments, the distribution, while being in a fixed relationship, can vary in dimensional spacing across the floor 216 of the substrate 210 (see, e.g., FIG. 10). In certain embodiments, each of the plurality of protrusions can be further characterized as having a top portion or "mesa" 244. The mesa 244 can comprise a relatively planar portion at the top of the respective protrusion, or an uppermost region of a protrusion that surrounds the distal extremity 215 of the protrusion, for example a substantially rounded peak.

The boundaries of the mesas 244 can be established as being within a "mesa depth" 248 (FIG. 11C) relative to the distal extremity 215. The mesa depth 248 can be characterized as being within a certain multiple or range of multiples of a characteristic parameter such as a roughness of the mesa 244, a roughness of a coating thickness or roughness, or one of the registration plane variances. A typical and non-limiting dimension for the mesa depth 248 is between about 0.3μη and 20μη. Another non-limiting dimension for the mesa depth 248 is about three to ten times the RMS roughness of a coating on the protrusion. Alternatively, the mesas 244 can be characterized as having a maximum or minimum dimension, or as being within a range of dimensions, on the respective registration plane.

In another embodiment, the mesa 244 is defined as the region of the protrusion that is within a fixed percentage of a height of the respective protrusion. As non-limiting examples, the mesa 244 can be defined as the region of the protrusion that is within 10% or 25% of the prominence height (discussed attendant FIG. 16 below) of the distal extremity 215. Other upper fractions of the prominence height can also be utilized to define the mesa depth 248, ranging, for example, from 2% to 50%.

Figure 12:
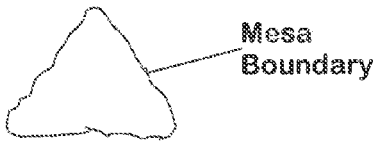
FIG. 12 is a boundary of a mesa in an embodiment of the invention.

The mesas 244 can be formed in a variety of shapes, such as rectangular, trapezoidal, ovular, circular or polygonal. Depending on the machining process utilized, the corners of mesas 244 may be rounded and the edges somewhat irregular. For example, a triangular shape formed by an abrasion machining technique will generally possess apexes or corners that are radiused and the boundary of the mesa 244 will generally be irregular, as depicted in FIG. 12.

Figure 13A:
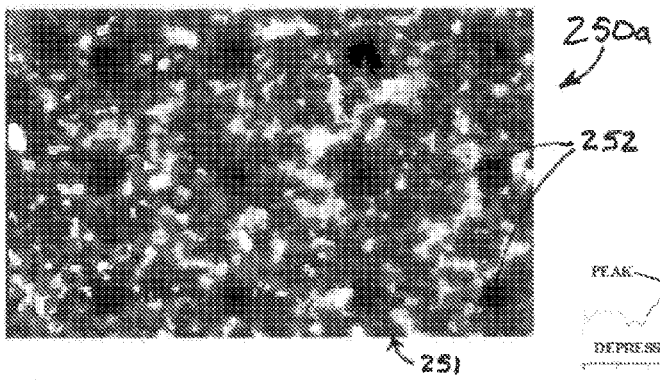
FIGS. 13A and 13B are laser confocal microscope images of a pad conditioner in embodiment of the invention.
Figure 13C:
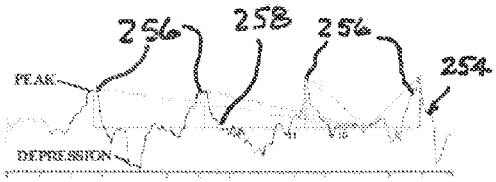
FIG. 13C is an enlarged contour of a series of peaks and depressions of a pad conditioner in an embodiment of the invention.
Figure 13B:
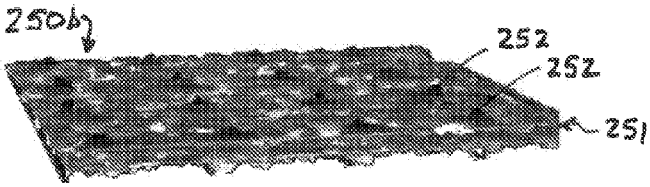

Referring to FIGS. 13A and 13B, laser confocal microscope images 250*a* and 250*b* of a substrate 251 are presented in an embodiment of the invention, from a top view and a perspective view, respectively. The topography of the images 250*a* and 250*b* present the highest elevations (protrusions 252) in black and the lowest elevations in white, with graduated grayscale in between. The black regions (peak elevations) reveal that the protrusions 252 of 250*a* and 250*b* define a matrixical grid.

The images are of protrusions 252 having 125μη base dimension at a protrusion density of 5/mm$^2$. The section of the substrate imaged in 250*a* and 250*b* were machined for substantially uniform heights, though heights of the protrusions on the particular substrate imaged ranged from about 35μη to about 55μη (i.e., an average peak height of 45μη with a variance of 20μη).

Referring to FIG. 13C, a contour 254 of a set of protrusions 256 from a section of the front face 258 of an embodiment of the invention is presented. The contour 254, as well as the laser confocal microscope images 250*a* and 250*b*, reveal an uneven or roughened microsurface on the front face 258, including the protrusions 256. The large variation in elevation of both the peaks and the depressions of the front face 258 can be attributed to the porous nature of the substrate.

Figure 14A:
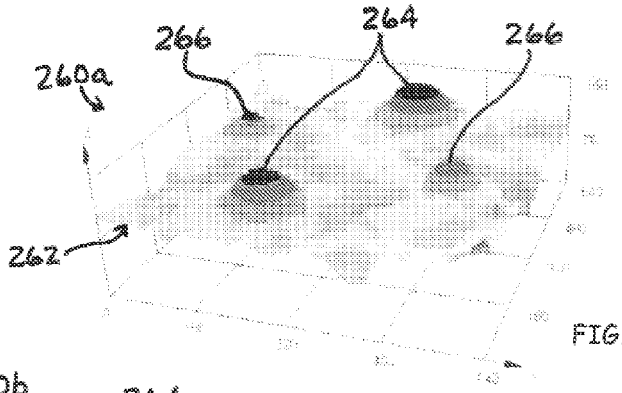
FIGS. 14A and 14B are laser confocal microscope images of a pad conditioner having interspersed protrusions of different heights in an embodiment of the invention.
Figure 14B:
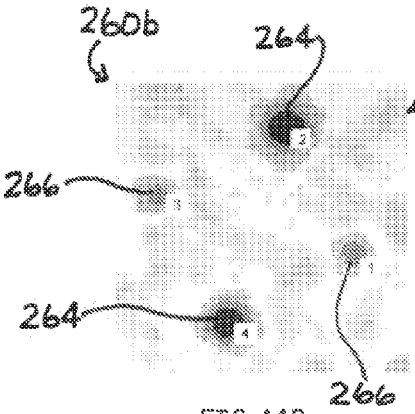
Figure 14C:
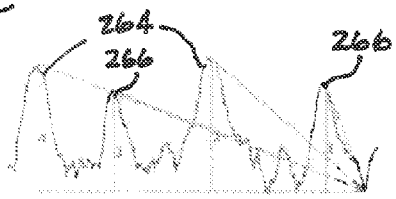
FIG. 14C is an enlarged contour of a series of peaks and depressions of a pad conditioner having interspersed protrusions of different heights in an embodiment of the invention.

Referring to FIGS. 14A through 14C (referred to collectively as FIG. 14), laser confocal microscope images 260*a* and 260*b* of a portion of a pad conditioner 262 having interspersed major and minor protrusions 264 and 266, respectively, is depicted in an embodiment of the invention. The images illustrate an irregular or rough surfaced embodiment, the major protrusions 264 captured in the images being of greater elevation than the minor protrusions 266. While the imaged major protrusions 264 are higher than the minor peaks 266, it is noted that, in some embodiments, not all "major protrusions" higher than all "minor protrusions." That is, in certain embodiments, the designation of "major" and "minor" protrusion is established by their location or pattern relative to each other, rather than by their height dimension. This aspect of certain embodiments of the invention is discussed below in relation to FIG. 15.

Figure 15:
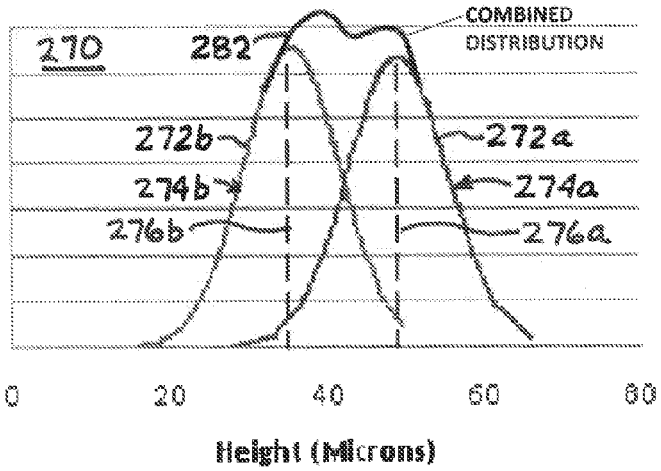
FIG. 15 is a graph of a bimodal distribution of major and minor protrusions in an embodiment of the invention.

Referring to FIG. 15, a graph 270 depicting example statistical distributions 272*a* and 272*b* of the prominence heights of the major and minor protrusions height variation, respectively, is presented for an embodiment of the invention. Each statistical distribution 272*a* and 272*b* can be said to represent two distinct protrusion populations 274*a* and 274*b*, respectively. In this non-limiting example, the statistical distribution of the major protrusions 272*a* have a central or average prominence height 276*a* of about 50μη, whereas the statistical distribution of the minor protrusions 272*b* have a central or average height 276*b* of about 35μη. The standard deviation of these particular distributions is on the order of about 5μη. Example and non-limiting ranges for the standard deviation are on the order of 1μη to 20μη.

A "combined" normalized distribution 282 is also presented in FIG. 15, combining and normalizing both protrusion populations 274*a* and 274*b*. The combined normalized distribution 282 can be characterized as a bimodal distribution, with a first local maxima at about 40μη and a second local maxima that is slightly less than 50μη. The distinction and separation distance between the peaks of a combined normalized distribution 282 will generally be greater as the separation between the individual protrusion populations 274*a* and 274*b* increases. Where the separation is sufficiently small, the combined distribution can merge into a single modal distribution having just one peak (not depicted).

Note that the two statistical distributions 272 and 274 overlap. Physically, this means that, at least for the example illustrated, there are members of the so-called "minor" protrusion population 274*b* that actually have a greater prominence height than certain members of the so-called "major" protrusion population 274*a*. In such cases, which population (274*a* or 274*b*) a given protrusion belongs to cannot be determined by the prominence height alone; a different metric is required to establish the members of a given population.

One way to identify the population is by the predetermined positions of the registration axes (e.g. registration axes 242 of FIG. 11A). In certain embodiments, the x-y position of every member of the major protrusion population 274*a* and of every member of the minor protrusion population 274*b* is known. Accordingly, one can group the protrusions based on the predetermined positions.

Another way to identify a population is by the base dimensions. While certain machining processes tend to produce heights and mesas of varying dimensions, the various machining processes tend to produce populations of substantially consistent base dimensions. Herein, a "base dimension" is defined as a characteristic dimension at or proximate the base of a protrusion, such as a diameter, the side of a rectangle, or a major or minor axis of a substantially elliptical shape. For example, a base dimension can be measured at a short distance up the protrusion from the floor 218 of the substrate, or from the lowest encircling contour line 306 (see FIG. 16 and attendant discussion, below). The distance up from these datum can be at a fixed length (e.g., 5 to 20μιη) or at a fixed percentage of a height of the protrusion (e.g., 5 to 20%). In one embodiment, the height of the protrusions are substantially similar while the base dimensions define two or more distinct populations. Accordingly, the various populations can be grouped according to the base dimensions.

While the illustrations and discussions above are generally directed to pad conditioners having two distinct protrusion populations, the present in invention is not so limited. That is, it is contemplated that more than two sets of protrusions of unique central prominence heights can be utilized. Such pad conditioners can be characterized as having major, minor and at least one intermediate protrusion set, and can produce a "polymodal" distribution (e.g., "trimodal") having more local maxima than the bimodal distribution depicted herein, if the separation between the central separations of the individual populations is sufficiently large.

Figure 16A:
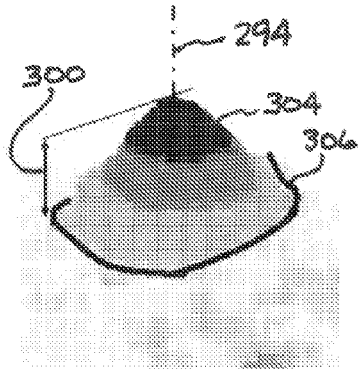
FIG. 16A is a perspective view of a protrusion having a prominence height in an embodiment of the invention.
Figure 16:
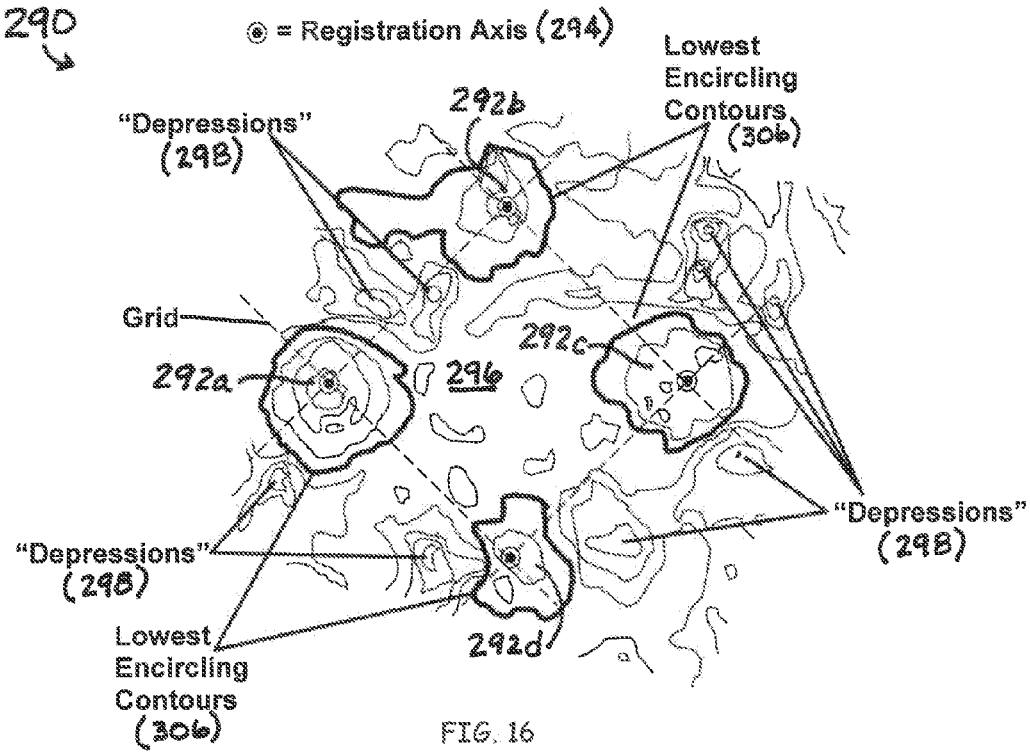
FIG. 16 is a topographical depiction of a part of a matrix of protrusions is presented for an embodiment of the invention.

Referring to FIGS. 16 and 16 A, a topographical depiction 290 of a part of a matrix of protrusions is presented for an embodiment of the invention. The topographical depiction shows four protrusions 292*a*, 292*b*, 292*c* and 292*d* (referred to collectively as protrusions 292), each having a registration axis 294. A "floor" 296 of the substrate can possess very deep and localized depressions 298. For example, "peak" and the "depression" labeled in of FIG. 13C can be construed as having similar dimensions in the frontal direction, depending on where the floor datum plane 238 (FIG. 11B) is located. Such extreme and random localized depressions can cause large variations in locating the average or median location of the floor datum plane 238.

The depressions 298 can be an artifact of the machining method. That is, an abrasion machining technique can be more prone to producing an uneven front surface than, for example, a laser machining technique. The depressions 298 can also be an artifact of the substrate material. Certain substrate materials can be porous, with some such materials having larger and wider ranging pore sizes than others. In some embodiments, the pore sizes are 20μιη or greater. The greater the porosity and/or pore sizes of a material, the greater the depressions, regardless of the machining technique.

To accommodate substrates having large variations in the topography of the floor 296, a "prominence height" metric is defined for establishing the height of protrusions. A "prominence height" 300 as used herein is defined as the distance between a distal extremity 302 (highest elevation point) of a protrusion 304 and a lowest encircling contour line 306 that encircles only the respective registration axis 294 of the protrusion and no other registration axes (FIG. 16A). The lowest contour lines 306 for the protrusions of FIG. 16 are shown in a heavier line weight in FIG. 16.

In one embodiment, the average prominence height of the minor protrusions can be expressed as being within a certain variance or standard deviation of a certain percentage of the average prominence height of the major protrusions. By way of non-limiting example, the minor protrusions can have an average prominence height that is 40% of the average prominence height of the major protrusions, within a standard deviation of 5%, where all percentages are referenced to the average prominence height of the major protrusions. A non-limiting range of average minor (or intermediate) protrusion heights is from approximately 20% to approximately 80% of the average prominence height of the major protrusions. A non-limiting range of the attendant standard deviations is from less than 1% to about 20%.

It is noted that the average heights and the average "valley-to-peak" heights, described supra, can be substituted in place of the prominence height ranges in the paragraph above.

Generally, the altitude of the lowest encircling contour lines 306 for the various registration axes 308 are within a tighter tolerance than the overall roughness of the floor 296. Hence, the use of the lowest encircling contour lines 306 can reduce the uncertainty associated with establishing the baseline from which the protrusion height is determined.

Figure 17:
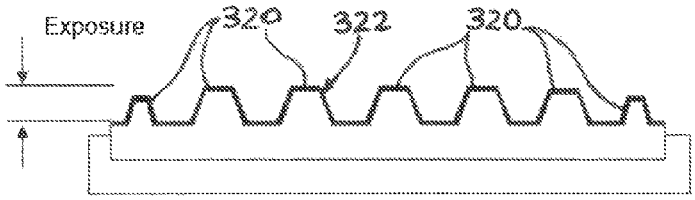
FIG. 17 is an enlarged sectional view of a portion of a pad conditioner having a coating of polycrystalline CVD diamond in an embodiment of the invention.

Referring to FIG. 17, protrusions 320 covered with a polycrystalline CVD diamond layer 322 are depicted in an embodiment of the invention. Various embodiments of the pad conditioner include CMP pad conditioners and methods for forming geometrical protrusions in a beta silicon carbide substrate material. The protrusions can be in the same size range as other available diamond crystal containing conditioners. However, in some embodiments, the protrusion features are of pre-determined varying size and height tailored to the specific CMP pad conditioning application. In one embodiment, a coating layer such as the polycrystalline CVD diamond is disposed on at least the upper surfaces of some of these protrusions.

The facets of the polycrystalline CVD diamond layer that coat the substrate protrusions provide the cutting action to open pores and create asperities in the CMP pad that is being conditioned. The protrusions on the substrate provide a surface on which to deposit the polycrystalline diamond coating and also create force concentrations at the conditioner and pad interface.

For embodiments where a near net shaped graphite substrate is converted to a silicon carbide substrate, the pore structure of the substrate can in some cases also provide a beneficial irregular or roughened surface for the growth of a polycrystalline diamond coating atop the protrusions. Thus, an advantage of the near net shaped graphite substrate precursor can be the high degree of porosity, which can achieve higher variability and roughness in the surface and a greater degree of roughness of the polycrystalline CVD diamond film upon deposition, especially roughness on top surfaces of the protrusions.

The average height of the protrusions may vary within a narrow range, which allows for differences in irregularities in the crystallites of the polycrystalline diamond coating as well as the irregularities of the underlying silicon carbide. The height of a set of protrusions can be established by the average of a plurality of heights of similar protrusions and can include a standard deviation. The protrusions can be further characterized by an average roughness of the surface of the top surface of the plurality of protrusions. The roughness of the protrusion tops surfaces can be due at least in part to the irregularities from the surface of the diamond crystallites and irregularities in the surface of the underlying silicon carbide.

Typical and non-limiting thicknesses for the coating of polycrystalline CVD diamond 322 is between 2μη and 30μη, with a root-mean-square roughness between 0.5μη and 10μη when no sampling length is considered and between 0.05μη and 1.0μη when an 8μη sampling length s considered. Herein, a "sampling length" is the length over which roughness data is accumulated.

Several manufacturing methods are available to make the protrusions on the substrate or segments. Non-limiting examples of methods of texturing the surface of a graphite or silicon carbide substrate include wire electrical discharge machining (EDM), masked abrasion machining, water jet machining, photo abrasion machining, laser machining, and conventional milling. Example machining techniques are disclosed in U.S. Patent Application Publication No. 2006/0055864 to Matsumura, et al, as well as PCT Publication No. WO/2011/130300 to Menor, et al, the disclosures of which are incorporated by reference in their entirety herein except for express definitions contained therein. The method chosen can provide flexibility for making protrusions of various size and height in different areas of the substrate. Machining features such as protrusions and channels between protrusions in graphite is much less expensive than forming similar features directly in SiC due to the extreme hardness of SiC.

Once a graphite substrate is converted to silicon carbide, it can be coated with the polycrystalline diamond layer using, for example, a hot filament CVD (HFCVD) process, as disclosed in Garg, et al, U.S. Pat. No. 5,186,973, issued Feb. 16, 1993, the contents of which are incorporated herein by reference in their entirety except for express definitions contained therein. For example, an HFCVD process for making a layer of polycrystalline diamond involves activating a feed gaseous mixture containing a mixture of a hydrocarbon and hydrogen by heated filament and flowing the activated gaseous mixture over a heated substrate or segment with protrusions to deposit the polycrystalline diamond film. The feed gas mixture, which can contain from about 0.1% to about 10% hydrocarbon in hydrogen, is thermally activated under sub-atmosphere pressure, i.e. no greater than about 100 Torr, to produce hydrocarbon radicals and atomic hydrogen by using a heated filament made of W, Ta, Mo, Re or a mixture thereof. The filament temperature ranges from about 1800° C. to 2800° C. The substrate can be heated to a deposition temperature in the range of about 600° C. to about 1100° C.

The total thickness of the polycrystalline CVD diamond layer on the CMP pad conditioner substrate and protrusions in versions of the invention can be in the range between 0.1 micron to 2 millimeters, in some versions from about 10 microns to 50 microns, and in still other versions about 10 microns to 30 microns thick.

A CVD coating of silicon carbide or silicon nitride can also be applied on one or more surfaces of a near net shaped silicon carbide substrate or a machined silicon carbide substrate, either as a final coating or as an intermittent coating prior to application of the polycrystalline diamond layer. After coating, the substrates can be assembled into their final configuration and then inspected and packaged. Direct machining of silicon carbide can also be utilized to form the protrusions and channels, followed optionally with the polycrystalline diamond, silicon carbide and/or silicon nitride coating(s). In some embodiments, the pad conditioner has a plurality of asperities (an irregular or roughened surface) at least atop the surfaces of the protrusions. Friction and wear originate at these top surfaces.

Figure 18A:
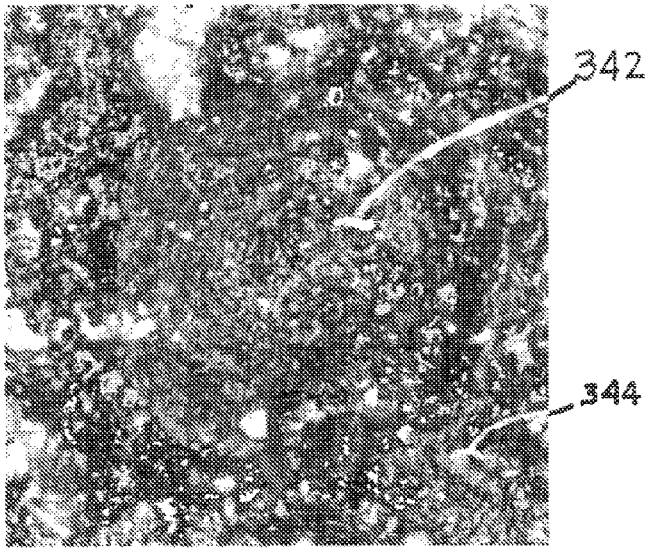
FIG. 18A is an enlarged image of an uncoated protrusion having a base dimension of about 200μη in an embodiment of the invention.
Figure 18B:
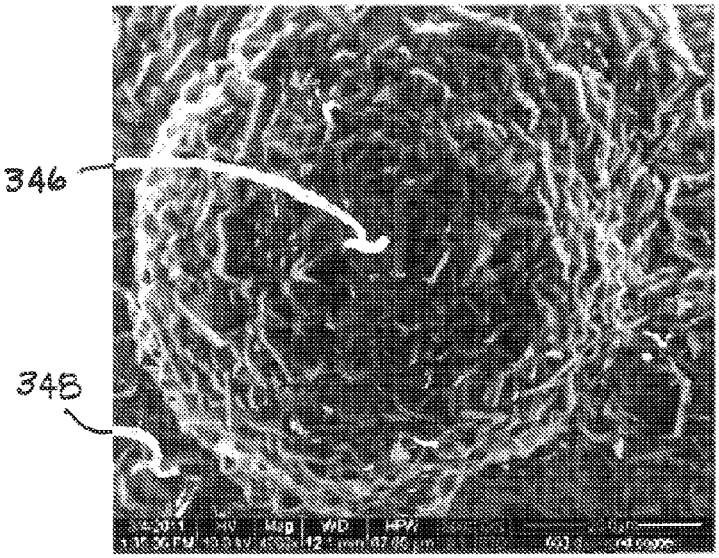
FIG. 18B is an enlarged image of a diamond coated protrusion having a base dimension of about 65μη in an embodiment of the invention.

Referring to FIGS. 18A and 18B, the ability to coat a protrusion with a layer of polycrystalline CVD diamond while preserving the roughness of the protrusion is illustrated in an embodiment of the invention. The image of FIG. 18A is that of a protrusion 342 prior to the protrusion 342 and surrounding substrate 344 being coated with polycrystalline CVD diamond. As FIG. 18A portrays, the substrate 344 has an irregular or rough surface both on the surface of the substrate 344 and on surface of the protrusion 342. The protrusion of FIG. 18A has a base dimension of approximately 200μη.

The image of FIG. 18B is an SEM image of a protrusion 346 and substrate 348 that is coated with a layer of polycrystalline CVD diamond in an embodiment of the invention. The imaged protrusion 346 has a base dimension of about 65μη. Note that the polycrystalline CVD diamond adheres to the irregularity of the protrusion 346 and substrate 348, including the irregular shape on the protrusions, and conforms to the irregular or roughened surface.

Thus, the polycrystalline CVD diamond coating provides a rough and jagged configuration that conforms to the shape of the underlying substrate and protrusion features, while providing the hardness and durability of polycrystalline CVD diamond. As a result, every surface of the pad conditioner that is in contact with a polishing pad during use is involved in the cutting and surface texturing. In some embodiments, the asperities may have an average height in the range of about 0.5μη to about 10μη; in other embodiments, the height range of the asperities may range from about 0.5μη to about 5μη, and in still other embodiments from about 1μη to about 3μη.

The silicon carbide, or near net shaped graphite that is converted to near net shaped silicon carbide, can be made by the methods and materials disclosed in "Properties and Characteristics of Silicon Carbide", Edited by A. H. Rashed, 2002, Poco Graphite Inc. Decatur, Tex. ("Poco reference"), available on the world wide web at URL: www.poco.com/AdditionalInformation/Literature/ProductLiterature/SiliconCarbide/tabid/194/Default.aspx, the contents of which are incorporated herein by reference in their entirety except for express definitions contained therein. The Poco reference discloses the properties of SUPERSIC-1, a SiC material, as typically having an average open porosity of 19% and an average closed porosity of 2.5% for a total porosity of 20.5%> (Poco reference, p. 7). SUPERSIC-1 can also be used as a precursor for the substrate. For example protrusions can be formed in a SUPERSIC-1 substrate by a photo-abrasion process to form the near net shaped substrate. The silicon carbide can also comprise SUPERSIC or SUPERSIC-3C, also available from Poco Graphite, Decatur, Tex. The graphite for near net shaped substrates that can be converted to near net shaped silicon carbide can also be obtained from Poco Graphite.

In some embodiments of the invention the silicon carbide is not a reaction-bonded silicon carbide material where a reaction-bonded silicon carbide is sintered alpha silicon carbide powder body with silicon infiltrated into the pore structure.

In certain embodiments of the invention, the silicon carbide phase as determined by x-ray diffraction comprises beta silicon carbide, in other versions the silicon carbide is only beta silicon carbide (β-SiC), and in still other versions the silicon carbide is essentially β-SiC. In yet still other versions of the invention the silicon carbide as determined by x-ray diffraction (based on relative peak areas) is greater than 50% of the β-SiC phase. In some versions of the pad conditioner, free silicon is not detectable in the beta silicon carbide by x-ray diffraction. The silicon carbide may optionally contain a carbon structure or phase.

Silicon carbide (SiC), as well as near net shaped graphite and silicon carbide precursors, used in versions of the invention can include porous and dense silicon carbides that may be made in part or in whole by the methods and materials disclosed in U.S. Pat. No. 7,799,375 Rashed, et al. Sep. 21, 2010, the contents of which are incorporated herein by reference in their entirety except for express definitions contained therein. Rashed discloses that "a porous silicon carbide preform having an open porosity is provided. The open porosity is preferably in a range of about 10% to about 60%>" (Rashed, col. 5, lines 44-46), with specific examples of open porosities of 18-19%>, 0.3%>, 0.2% and 2.3% tabulated in Table 1 (Rashed, col. 7, lines 36-50). In one example, a porous graphite substrate from Poco Graphite can be heated at 1800° C. in the presence of silicon monoxide gas to convert the porous graphite to porous silicon carbide substrate. Accordingly, in some versions of the present invention, a near net shaped porous graphite substrate with protrusions can be heated at 1800° C. in the presence of silicon monoxide gas to convert the near net shaped porous graphite to a near net shaped porous silicon carbide.

Surface roughness can be characterized in a number of ways, including peak-to-valley roughness, average roughness, and root-mean-square (RMS) roughness. Peak-to-valley roughness (Rt) is a measure of the difference in height between the highest point and lowest point of a surface. Average roughness (Ra) is a measure of the relative degree of coarse, ragged, pointed, or bristle-like projections on a surface, and is defined as the average of the absolute values of the differences between the peaks and their mean line. RMS roughness (Rq) is a root mean square average of the distances between the peaks and valleys. Herein, "Rp" is the height of the highest peak above the centerline in the Sample length, "Rpm" is the mean of all of the Rp values over all of the sample lengths, "Ra" is the average roughness, "Rq" is the RMS roughness, and "Rt" is the peak-to-valley roughness. The various roughness parameters can be measured at each location of a substrate and protrusion top surfaces.

Figure 19A:
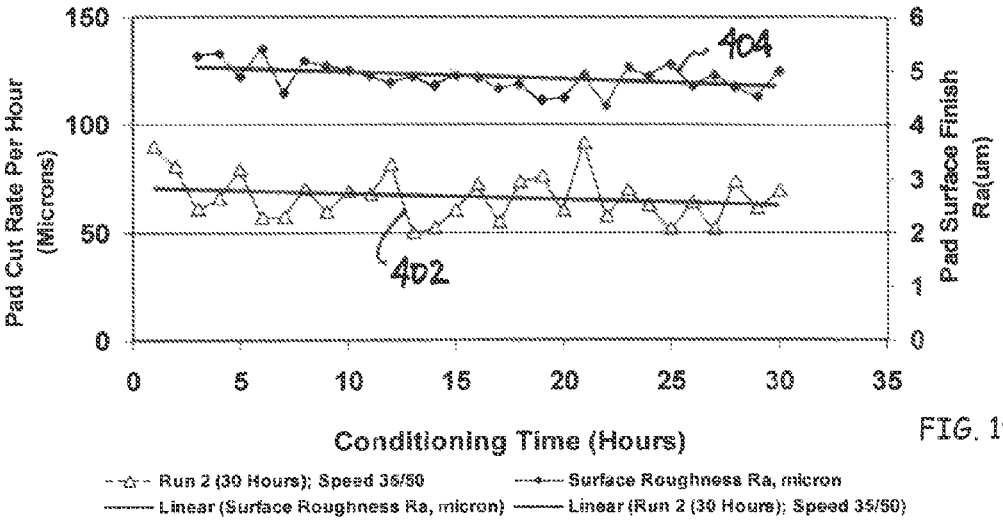
FIGS. 19A and 19B are graphs of the pad cut rate and the pad surface finish of embodiments of the invention.
Figure 19B:
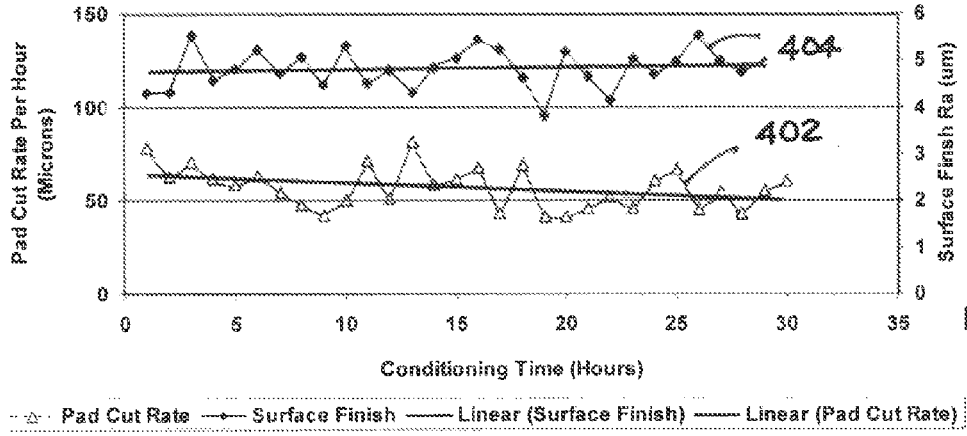

Referring to FIGS. 19A and 19B, a cut rate 402 of a pad conditioner in an embodiment of the invention is presented, along with the surface finish 404 of the conditioned polishing pad. In FIG. 19A, the protrusions have a base dimension of nominally 125μιη (e.g., square, diameter or other) and at a density of 3 protrusions per $mm^2$. In FIG. 19B, the protrusions have a base dimension of nominally 65μιη and at a density of 3 protrusions per $mm^2$. The FIG. 19 demonstrate the process control and uniformity of the subject embodiments of the invention.

Figure 20:
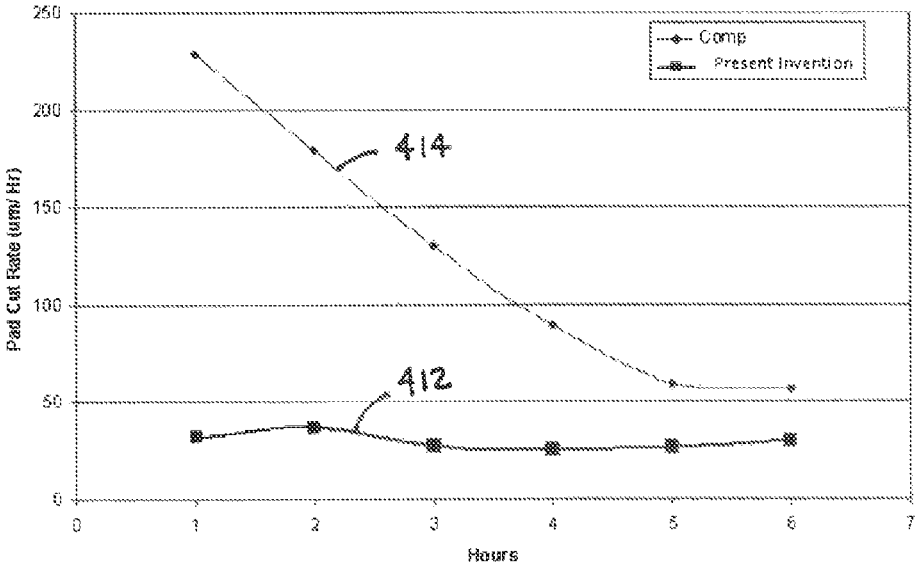
FIG. 20 is a graph comparing the pad cut rate of the present invention with a commercially available pad conditioner.

Referring to FIG. 20, a polishing pad cut rate 412 in an embodiment of the invention compared to a cut rate 414 of conventional aggressive and fine gritted conditioners of the typical diamond conditioner that has a sharp cut rate reduction curve and is susceptible to diamond chipping/removal. The trends of FIG. 20 illustrate at least two advantages of embodiments of the invention: First, the cut rate 414 of the polishing pad for the embodiment of the invention is consistently lower than the cut rate 416 of the conventional conditioners of the typical diamond conditioner. The lower cut rate 414 translates to less material removed from the polishing pad, thus prolonging the life of the polishing pad. Second, the cut rate 414 of the polishing pad for the embodiment of the invention is more consistent than the cut rate 416 of the conventional conditioners, making prediction of material removal more reliable.

Figure 21:
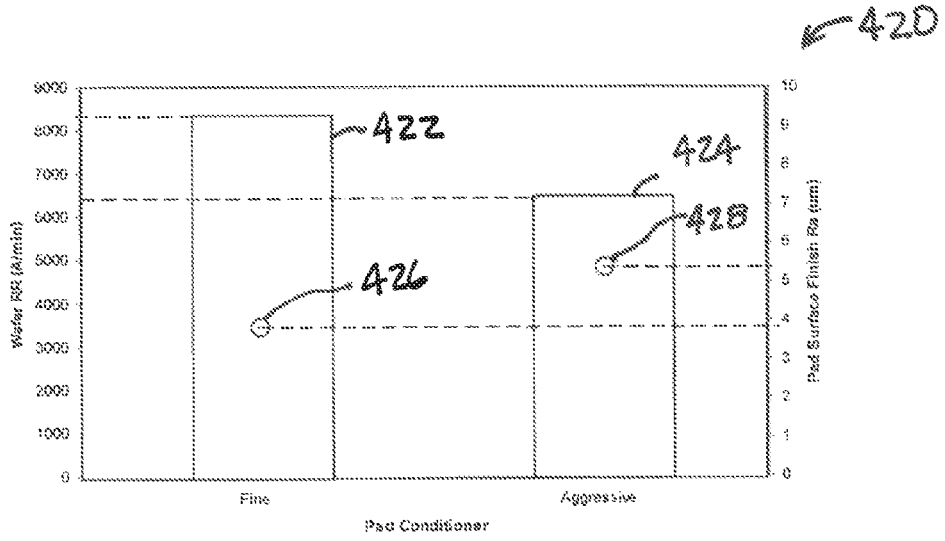
FIG. 21 is a graph comparing the wafer removal rate and pad surface finish of an embodiment of the invention with a commercially available pad conditioner.

Referring to FIG. 21, a comparative illustration of copper polishing results 420 between a pad conditioner of an embodiment of the invention and a commercially available pad conditioner is presented. For the comparison, the embodiment of the present pad conditioner was a fine roughness comprising protrusions of 85μιη base dimension at a protrusion density of 5/$mm^2$, and the commercial pad conditioner was an Araca APD-800 CMP polisher (FujiFilm Planar Solutions, model no. CSL9014C). Both pad conditioners were implemented with a copper slurry on an industry standard IC1000 pad.

As illustrated in FIG. 21, the Wafer Removal Rate ("RR") 422 for the pad conditioners of the present invention is 8373 angstroms per minute (A/min) compared to 6483 A/min for the commercially available pad conditioner (numerical reference 424). The roughness (Ra) of the resultant polishing pad surface finishes for each system are also provided, denoted by the open circle data points 426 and 428. The data shows that the polishing pad surface finish 426 for the pad conditioners of embodiments of the invention is about 3.8μιη Ra compared to the surface finish 428 of about 5.3μιη Ra for the commercially available pad conditioner.

Accordingly, the subject embodiment of the invention provides a wafer removal rate that is higher while providing a smoother polishing pad surface finish than that of the commercially available pad conditioner. Thus, the performance of the polishing pad treated with embodiments of the pad conditioner of the invention meets or exceeds the performance of a polishing pad treated with commercially available conditioners, even though the pad cut rate (e.g., FIG. 20) is less (i.e., less material is removed from the polishing pad).

Figure 22:
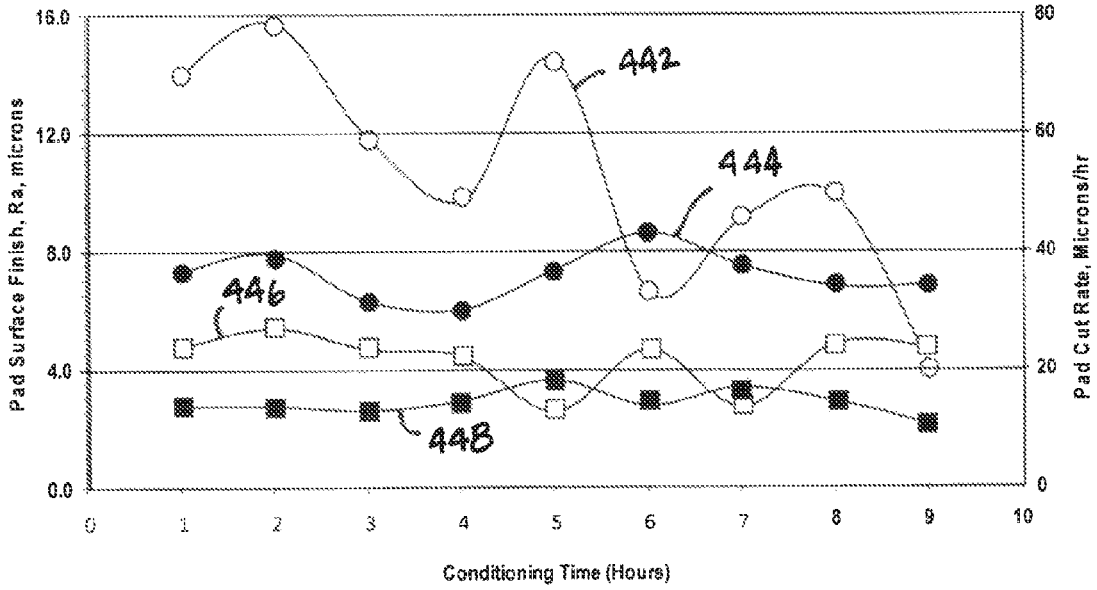
FIG. 22 is a graph comparing the pad surface finish and the pad cut rate of an embodiment of the invention with a commercially available pad conditioner.

Referring to FIG. 22, a comparative graph of the pad cut rate 440 (microns/hr) and pad surface roughness (Ra) between a pad conditioner of an embodiment of the invention and commercial pad conditioners is presented. For the comparison, the pad conditioner of an embodiment of the invention comprised protrusions having nominally 125μιη base dimensions and 3 protrusions/$mm^2$, while the commercial pad conditioner was as described in the discussion of FIG. 21 ("Comp Aggressive"). Data sets 442 and 444 depicted with circles correspond to cut rate (right axis), while data sets 446 and 448 depicted with squares correspond to pad surface finish (left axis). The data sets 442 and 446 having open circles and squares correspond to the commercially available product, while the data sets 444 and 448 having filled circles and squares correspond to the present invention.

As provided in the illustration, the pad cut rate and pad surface roughness are relatively steady for the pad conditioner of an embodiment of the invention compared to the commercial pad conditioners. The surface finish of an embodiment of the invention was also typically smoother than with the commercially available pad conditioner.

As used herein and in the appended claims, the singular forms "a", "an", and "the" include plural reference unless the context clearly dictates otherwise. Thus, for example, reference to a "protrusion" is a reference to one or more protrusions and equivalents thereof known to those skilled in the art, and so forth. Unless defined otherwise, all technical and scientific terms used herein have the same meanings as commonly understood by one of ordinary skill in the art. Methods and materials similar or equivalent to those described herein can be used in the practice or testing of embodiments of the present invention. All publications mentioned herein are incorporated by reference in their entirety, except for express definitions contained therein. Nothing herein is to be construed as an admission that the invention is not entitled to antedate such disclosure by virtue of prior invention. "Optional" or "optionally" means that the subsequently described event or circumstance may or may not occur, and that the description includes instances where the event occurs and instances where it does not. All numeric values herein can be modified by the term "about," whether or not explicitly indicated. The term "about" generally refers to a range of numbers that one of skill in the art would consider equivalent to the recited value (i.e., having the same function or result). In some embodiments the term "about" refers to ±10% of the stated value, in other embodiments the term "about" refers to ±2% of the stated value. While compositions and methods are described in terms of "comprising" various components or steps (interpreted as meaning "including, but not limited to"), the compositions and methods can also "consist essentially of" or "consist of the various components and steps, such terminology should be interpreted as defining essentially closed-member groups.

Although the invention has been shown and described with respect to one or more implementations, equivalent alterations and modifications will occur to others skilled in the art based upon a reading and understanding of this specification and the drawings. The invention includes all such modifications and alterations and is limited only by the scope of the following claims. In addition, while a particular feature or aspect of the invention may have been disclosed with respect to only one of several implementations, such feature or aspect may be combined with one or more other features or aspects of the other implementations as may be desired and advantageous for any given or particular application. Furthermore, to the extent that the terms "includes", "having", "has", "with", or variants thereof are used in either the detailed description or the claims, such terms are intended to be inclusive in a manner similar to the term "comprising." Also, the term "exemplary" is merely meant to mean an example, rather than the best. It is also to be appreciated that features, layers and/or elements depicted herein are illustrated with particular dimensions and/or orientations relative to one another for purposes of simplicity and ease of understanding, and that the actual dimensions and/or orientations may differ substantially from that illustrated herein.

Although the invention has been described in considerable detail with reference to certain embodiments thereof, other versions are possible. Therefore the spirit and scope of the appended claims should not be limited to the description and the versions contain within this specification. While various compositions and methods are described, it is to be understood that this invention is not limited to the particular molecules, compositions, designs, methodologies or protocols described, as these may vary. It is also to be understood that the terminology used in the description is for the purpose of describing the particular versions or embodiments only, and is not intended to limit the scope of the present invention which will be limited only by the appended claims.

The invention claimed is:

1. A chemical mechanical polishing pad conditioner, comprising:

a substrate including a front surface having a plurality of protrusions integral therewith, said plurality of protrusions extending in a frontal direction that is substantially normal to said front surface, each of said plurality of protrusions including a distal extremity, said plurality of protrusions including:

a subset of said plurality of protrusions having said distal extremities that are within a variance of a registration plane, said registration plane being substantially parallel to said front surface, the protrusions of said subset of said plurality of protrusions being located on said registration plane in a fixed and predetermined relationship relative to each other; and a coating of polycrystalline diamond that covers at least said distal extremities of said subset of said plurality of protrusions, wherein said substrate has a porosity of at least 10%.

2. The pad conditioner of claim 1, wherein said substrate includes pore dimensions greater than 20 μm.

3. The pad conditioner of claim 1, wherein each of said distal extremities is located on a mesa of a respective protrusion of said subset of said plurality of protrusions, said mesa defined as being within a predetermined distance from said distal extremity of the respective protrusion in a direction opposite said frontal direction.

4. The pad conditioner of claim 3 wherein said predetermined distance from said distal extremity is between about 0.3 μm and 20 μm.

5. The pad conditioner of claim 3, wherein said coating of polycrystalline diamond on said distal extremities of said protrusions has a root-mean-square roughness across said mesa, and wherein said predetermined distance from said distal extremity is about three to five times said root-mean-square roughness.

6. The pad conditioner of claim 5, wherein said root-mean-square roughness of said polycrystalline diamond across said mesa is between 0.5 μm and 10 μm.

7. The pad conditioner of claim 3, wherein said mesa is defined as a fixed percentage of a prominence height of said respective protrusion.

8. The pad conditioner of claim 7, wherein said fixed percentage is within a range of 5% to 50%.

9. The pad conditioner of claim 1, wherein said variance is in the range of 5 μm to 50 μm.

10. The pad conditioner of claim 9, wherein said variance is in the range of 10 μm to 25 μm.

11. The pad conditioner of claim 3, wherein said substrate is comprised of silicon carbide.

12. The chemical mechanical polishing pad conditioner of claim 1, wherein said porosity is less than 60%.

13. A chemical mechanical polishing pad conditioner, comprising:

a substrate including a front surface having a plurality of protrusions integral therewith, each of said plurality of protrusions extending in a frontal direction about a respective registration axis normal to said front surface, each of the respective registration axes defining a predetermined location on said front surface of said substrate, said plurality of protrusions including:

a first subset of protrusions identified by said predetermined locations on said front surface, said predetermined locations of said first subset of protrusions defining a first predetermined pattern, said first subset of protrusions having a first average height; and a second subset of protrusions identified by said predetermined locations on said front surface, said predetermined locations of said second subset of protrusions defining a second predetermined pattern, said second subset of protrusions having a second average height, said second average height being less than said first average height, at least a portion of said second subset of protrusions being interspersed amongst at least a portion of said first subset of protrusions, wherein a fraction of said second subset of protrusions have respective heights that are greater than the respective height of at least one of said first subset of protrusions, wherein said substrate has a porosity of at least 10%.

14. The chemical mechanical polishing pad conditioner of claim 13 wherein at least one of said first predetermined pattern and said second predetermined pattern is matrixical.

15. The chemical mechanical polishing pad conditioner of claim 14 wherein said fraction of said second subset of protrusions having respective heights greater than the respective heights of at least one of said first subset of protrusions is greater than 20%.

16. The chemical mechanical polishing pad conditioner of claim 13, wherein said first average height, said second average height and said respective heights are prominence heights, and wherein said first average height is greater than 100 μm and said second average height is less than 100 μm.

17. The chemical mechanical polishing pad conditioner of claim 13, wherein said first average height, said second average height and said respective heights are prominence heights, and wherein said first average height is greater than 40 μm and said second average height is less than 40 μm.

18. The chemical mechanical polishing pad conditioner of claim 13, wherein said porosity is less than 60%.

19. A pad conditioner comprising a substrate with a matrixical arrangement of raised cutting regions, each of the cutting regions having irregularly shaped peaks with respect to adjacent cutting regions, wherein the substrate, including a front surface having a plurality of protrusions integral therewith, each of said plurality of protrusions extending in a frontal direction about a respective registration axis normal to said front surface, each of said plurality of protrusions including a distal extremity located on a mesa of the respective protrusion, said mesa defined as being within a predetermined distance from said distal extremity of the respective protrusion in a direction opposite said frontal direction, each of the respective registration axes defining a predetermined location on said front surface of said substrate, each of said plurality of protrusions defining a cross-section at the base of said mesa, said cross-section defining a centroid, wherein, for at least a portion of said plurality of protrusions, said centroid of each of said cross-sections is offset from said respective registration axis.

20. The conditioner of claim 19, wherein each of the cutting regions having a peak of a different elevation compared to the elevation of the respective peaks of adjacent cutting regions in the matrixical arrangement.

21. The pad conditioner of claim 19, wherein each of said cross-sections defines a respective major dimension, and wherein, for said portion of said plurality of protrusions, said centroid of said cross-section is offset from said respective registration axis by a distance that is at least 5% of said major dimension.

22. The pad conditioner of claim 19, wherein said mesa is defined as a fixed percentage of a prominence height of said respective protrusion, said fixed percentage ranging from 5% to 10% of said prominence height.

23. The pad conditioner of claim 19 further comprising:

a first subset of protrusions that defines a first pattern; and a second subset of protrusions that defines a second pattern, wherein at least a portion of the protrusions from said second subset of protrusions are interspersed amongst at least a portion of the protrusions from said first subset of protrusions.

* * * * *